United States Patent [19]

Tateno et al.

[11] Patent Number: 5,052,876

[45] Date of Patent: Oct. 1, 1991

[54] UNPACKAGING APPARATUS FOR PACKAGED SHEETS

[75] Inventors: Yoshie Tateno; Tsunekazu Itaya, both of Tokyo, Japan

[73] Assignee: Kabusiki Kaisha Tateno Kikai Seisakusho, Tokyo, Japan

[21] Appl. No.: 581,516

[22] Filed: Sep. 6, 1990

[30] Foreign Application Priority Data

Sep. 19, 1989 [JP] Japan ..... 1-240860

[51] Int. Cl.[5] ..... B65B 69/00; B65H 3/24; B65H 1/26

[52] U.S. Cl. ..... 414/412; 83/835; 271/97; 414/416

[58] Field of Search ..... 414/412, 416; 271/97; 83/404.1, 404.2, 404.3, 835

[56] References Cited

U.S. PATENT DOCUMENTS

| | | | |
|---|---|---|---|
| 3,889,442 | 6/1975 | Grahn et al. | 414/412 X |
| 4,531,878 | 7/1985 | Tamura | 414/412 |
| 4,696,615 | 9/1987 | Ettischer et al. | 414/412 X |
| 4,995,784 | 2/1991 | Boisseau | 414/412 X |
| 4,997,329 | 3/1991 | Hanamoto et al. | 414/412 |

FOREIGN PATENT DOCUMENTS

| | | | |
|---|---|---|---|
| 208449 | 8/1988 | Japan | 414/412 |
| 199837 | 8/1989 | Japan | 414/412 |
| 88/10226 | 12/1988 | World Int. Prop. O. | 414/412 |

*Primary Examiner*—David A. Bucci

*Attorney, Agent, or Firm*—Oldham & Oldham Co.

[57] ABSTRACT

An unpackaging apparatus for packaged sheets is disclosed. The apparatus automatically takes out sheets by unpackaging a packaging sheet containing the packaged sheets used for a printer or the like. The packaging sheet is carried from a packaging sheet loading unit to a transfer unit by adsorptively holding the packaging sheet with a carrier mechanism. The packaging sheet is guided to a predetermined position of an unpackaging unit with a guide mechanism provided in the transfer unit. The front and side faces of the packaging sheet are cut off to vertically expand the packaging sheet. The sheets are removed from the packaging sheet and rearranged by a sheet rearranging mechanism. The sheets are loaded in a housing unit. The empty packaging sheet from which the sheets have been removed is discharged from a part vicinal to the unpackaging unit by a discharge mechanism. Furthermore, to promote drying and separation of the printed sheets by utilizing this apparatus, the bulk sheets are loaded on the packaging sheet loading unit and transferred to the transfer unit by a feed mechanism. The sheets passing through the unpackaging unit are unbound for sheet separation. The sheets are rearranged by the sheet rearranging mechanism and loaded in the housing unit.

8 Claims, 19 Drawing Sheets

UNPACKAGING APPARATUS FOR PACKAGED SHEETS

BACKGROUND OF THE INVENTION

The present invention relates to an unpacking apparatus for packaged sheets, the apparatus feeding the sheets loaded in bulk in a sheet loading unit onto a transfer board.

This type of conventional unpackaging apparatus for packaged sheets is disclosed in Japanese Patent Laid-Open Publication No. 208449/1988. The apparatus is constructed as follows. The uppermost packaging sheet among the multistage-loaded packaging sheets is moved forwards by a press shift member. With this forward movement, the right and left side faces of the packaging sheet are automatically cut off. The front face of the packaging sheet is cut off just when the forward movement stops. Thereafter, the sheets are pulled out of the packaging sheet which has been unpackaged up and down. The empty packaging sheet is adsorbed by suckers. With a retreat of the press shift member, the empty packaging sheet is fed back above the loaded sheets and then discharged by a discharge belt.

The prior art method disclosed in the foregoing publication presents the following defects. The empty packaging sheet is fed back above the loaded sheets and thereafter discharged. Hence, a feedback stroke from an unpackaging position of the packaging sheet to a discharge position is long. A time loss becomes large, correspondingly. This results in a drop in processing efficiency.

SUMMARY OF THE INVENTION

It is a primary object of the present invention, which has been devised to obviate the above-mentioned defects inherent in the prior art apparatuses, to provide an unpackaging apparatus for packaged sheets, the apparatus being capable of eliminating a time loss by discharging an empty packaging sheet directly from the unpackaging position, improving a processing capability and preventing damages to the sheets in execution of an unpackaging process by carrying the loaded packaging sheet while being surely underslung-held and by promoting separation between the sheets.

To accomplish this object, according to one aspect of the invention, there is provided an unpackaging apparatus for packaged sheets, comprising: a packaging sheet loading unit loaded with packaging sheets or bulk sheets; a housing unit for housing the processed sheets; and a means, provided between the packaging sheet loading unit and the housing unit, for processing the packaging sheets or the bulk sheets, the processing means including: a carrier means for carrying the packaging sheet of the loading unit to the transfer unit by adsorptively holding the packaging sheet; a guide means, provided in the transfer unit, for guiding the carried packaging sheet to a predetermined position of an unpackaging unit; a means, provided in the unpackaging unit, for cutting front and side faces of the packaging sheet; a means for vertically expanding the cut packaging sheet; a rearranging means for rearranging the sheets removed from the expanded packaging sheet and loading the sheets in the housing unit; a discharge means for discharging the empty packaging sheet from which the sheets have been removed from a vicinal to the unpackaging unit; and a feed means for feeding the bulk sheets of the loading unit to the transfer unit.

In accordance with this invention, the uppermost packaging sheet among the multistage-loaded packaging sheets is adsorptively underslung-held and carried to the transfer unit. The packaging sheet carried by the sheet push member provided in the transfer unit is moved forwards to the unpackaging unit. With this forward movement, the right and left side faces of the packaging sheet are automatically cut off. When stopping the forward movement, the front face thereof is cut off. Thereafter, the packaging sheet is unpackaged up and down, and the sheets are pulled out of the packaging sheet. The empty packaging sheet is adsorptively raised by the suckers. The empty packaging sheet is discharged from the discharge unit provided on one side of the unpackaging unit.

According to the present invention, the multistage-loaded packaging sheets are adsorptively held by the carrier member. The packaging sheets can be carried by surely separating them even when applying glues between the loaded packaging sheets to prevent a load collapse. The carried packaging sheets drop onto the transfer board in the transfer unit. At this time, the sheets contained in the packaging sheet are unbound and well separated. In the unpackaging unit, the front cutter safely unseals the packing sheet by push-cutting without damaging the sheets contained therein. The empty packaging sheet from which the sheets have been removed are adsorptively raised by the suckers. The empty packaging sheet is quickly discharged from the discharge unit provided on one side in the vicinity of the unpackaging unit. This makes unnecessary the steps of, as performed by the prior art methods, feeding the empty packaging sheet back to the packaging sheet loading unit and discharging it. It is therefore possible to eliminate the time loss and adsorptively hold the next packaging sheet with the carrier member. A series of such operations lead to an excellent advantage to provide the unpackaging apparatus for the packaged sheets which exhibits a high efficiency and improves a processing capability.

BRIEF DESCRIPTION OF THE DRAWINGS

Other objects and advantages will become apparent during the following discussion taken in conjunction with the accompanying drawings, in which.

DESCRIPTION OF THE PREFERRED EMBODIMENT

The following is a detailed description of an illustrative embodiment of an apparatus for unpackaging a packaging sheet.

Figure 1:
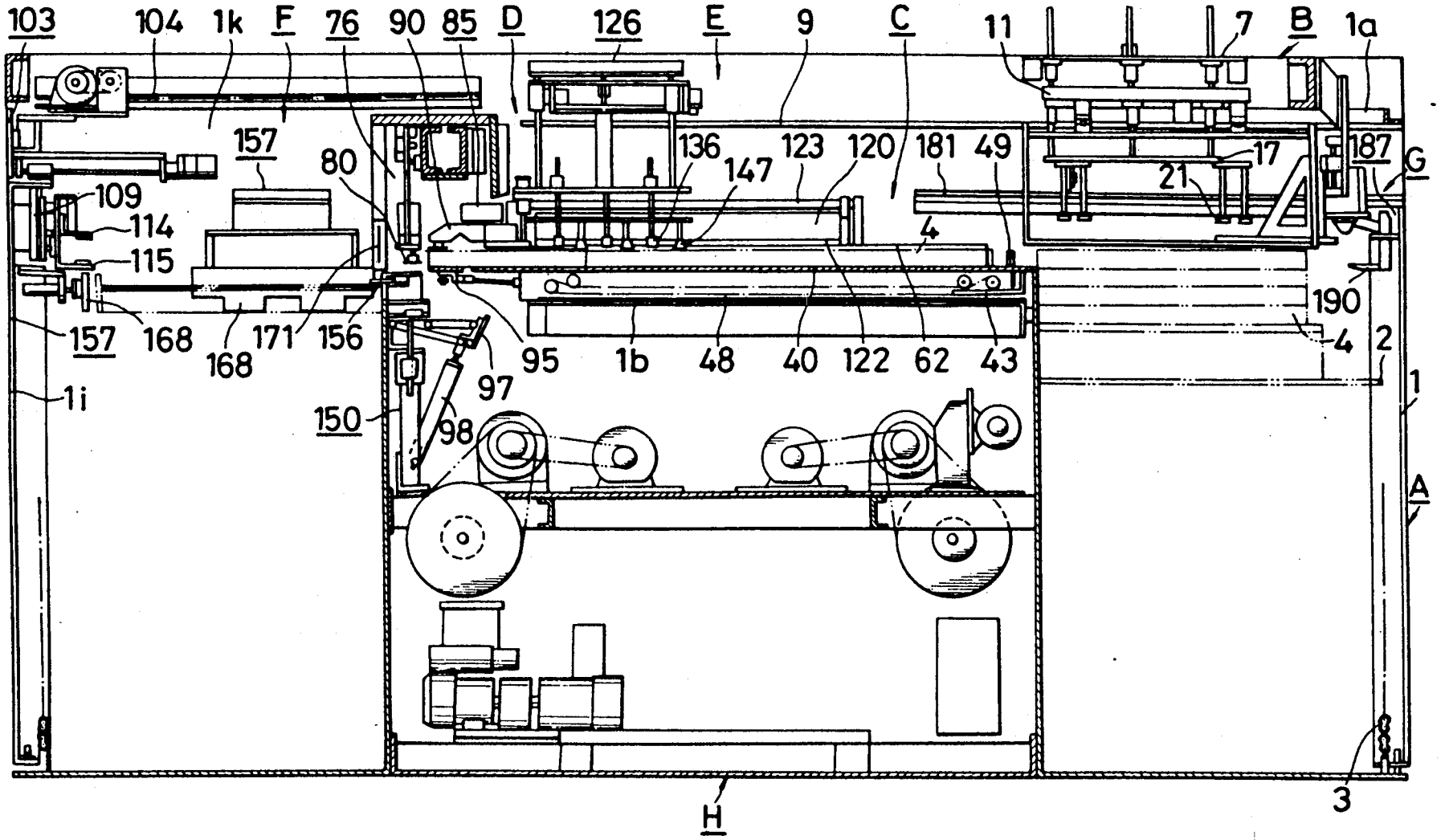
FIG. 1 is a vertical sectional view depicting a whole apparatus in which the present invention is embodied.
Figure 2:
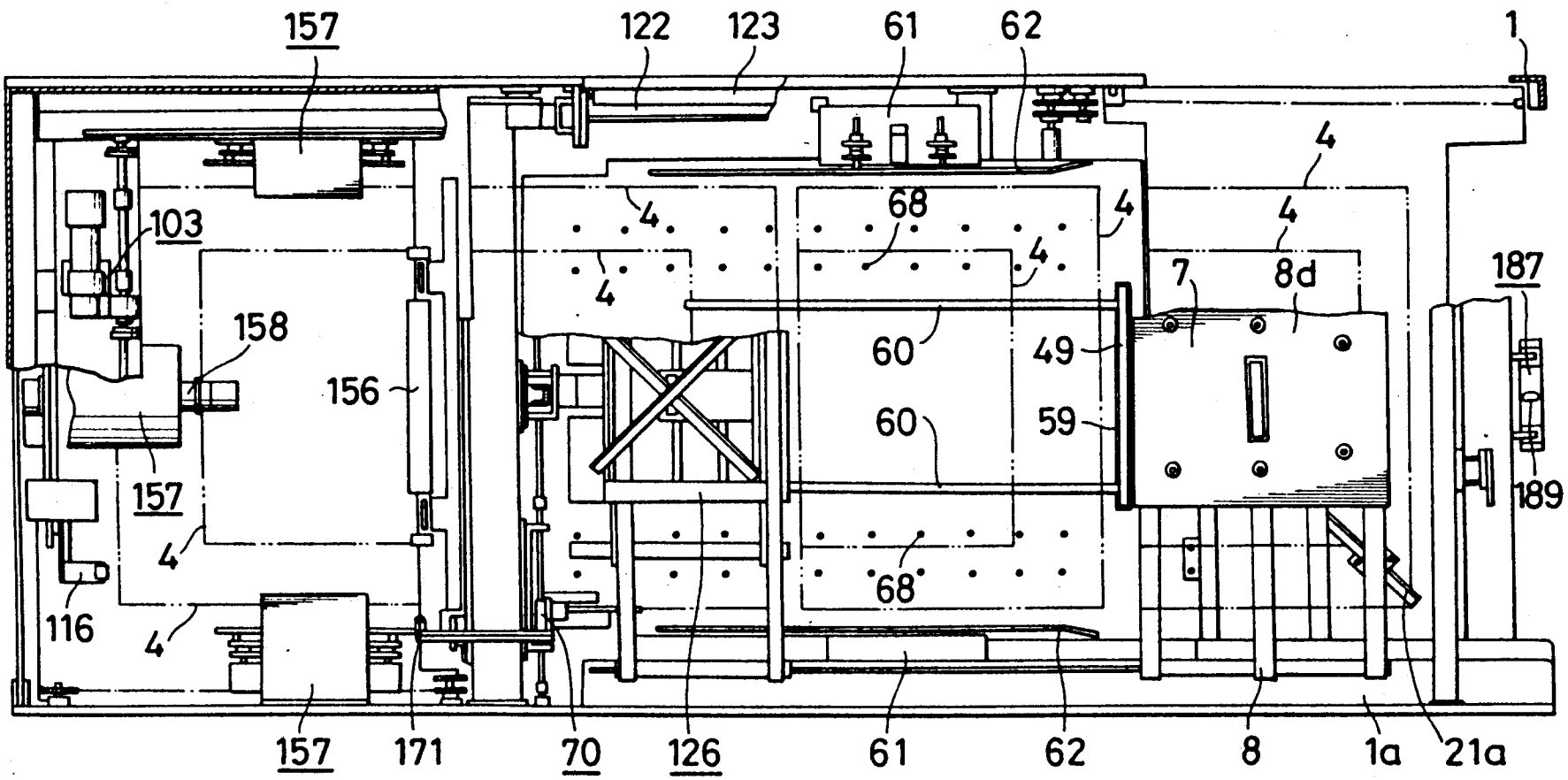
FIG. 2 is a cross-sectional plan view thereof.
Figure 3:
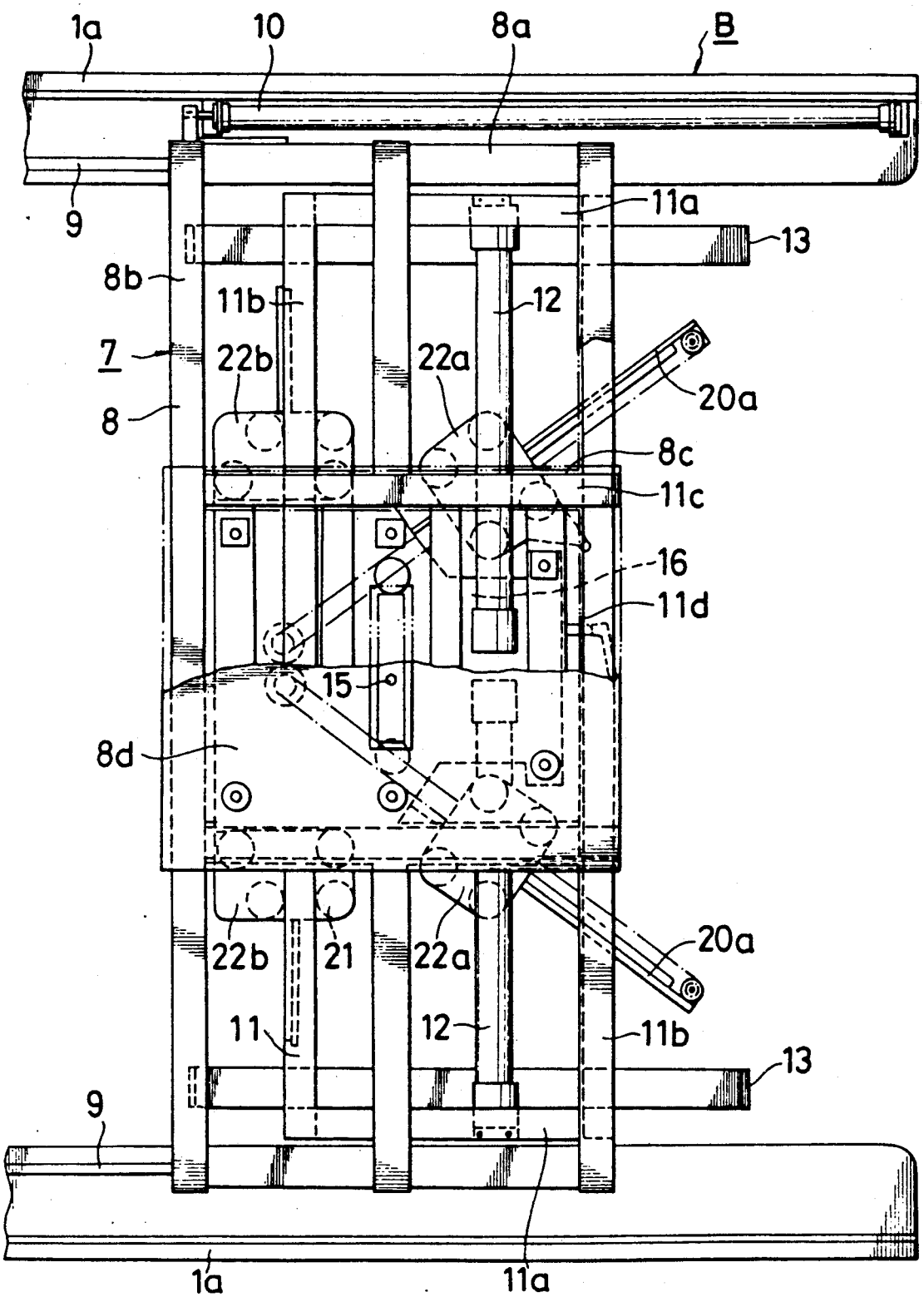
FIG. 3 is a partially cut-away plan view showing a carrier member.
Figure 4:
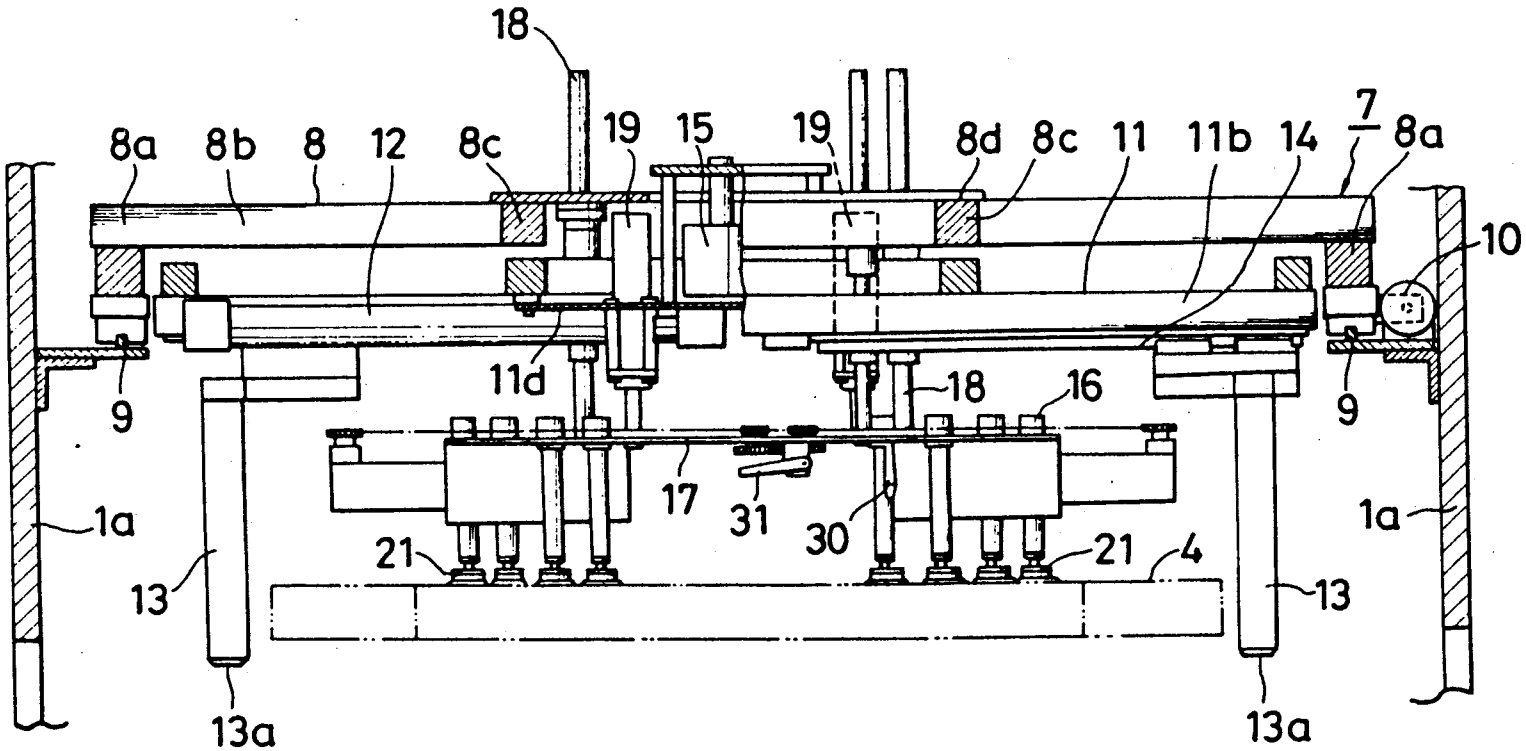
FIG. 4 is a partially cut-away side view in vertical section, illustrating the same carrier member.
Figure 5:
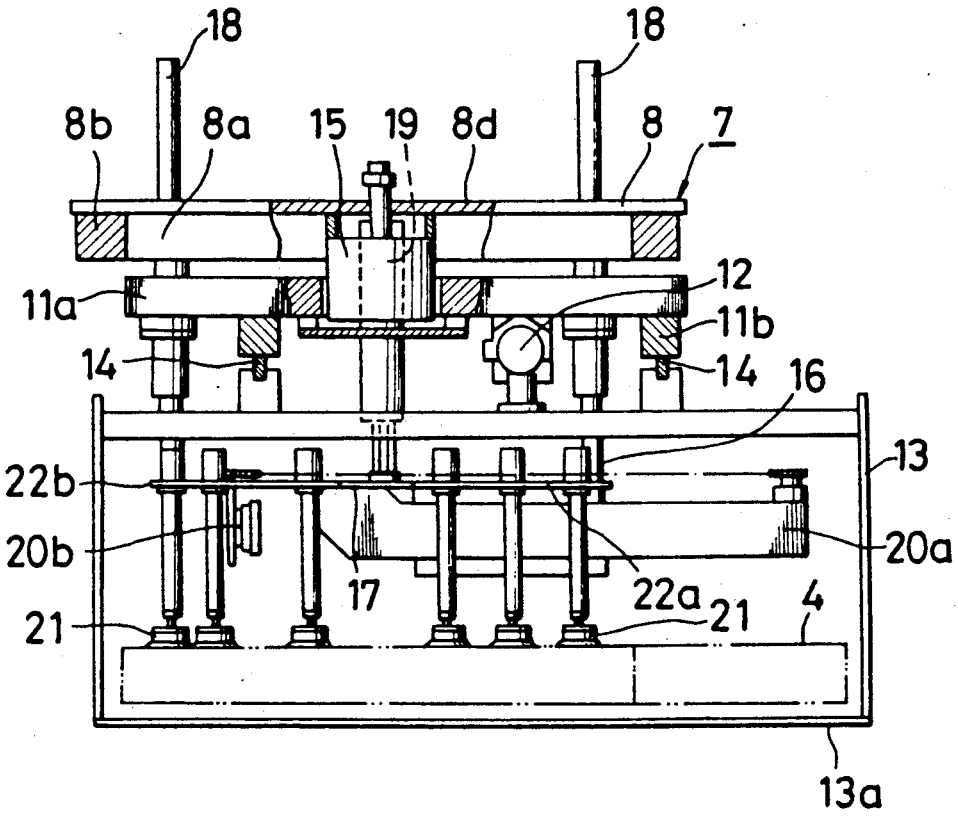
FIG. 5 is a partially cut-away front elevation illustrating the same carrier member.
Figure 7:
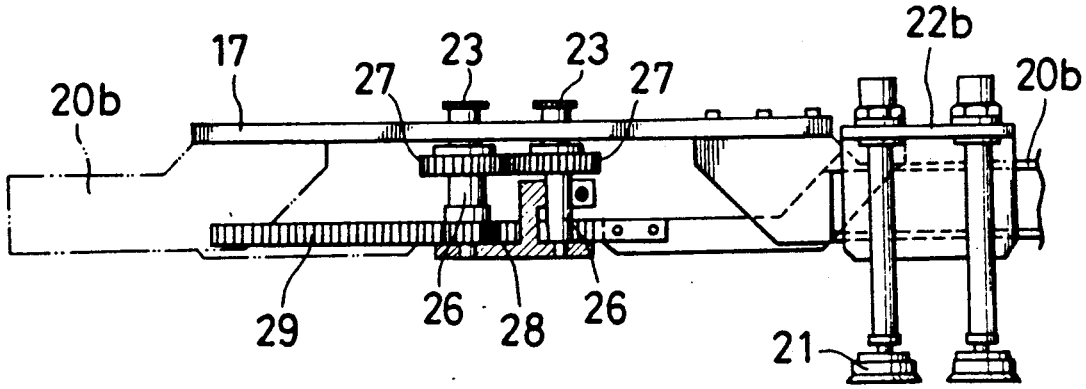
FIG. 7 is a side view illustrating the principal portion of the same sucker fitting member.

Turning to FIGS. 1 and 2, there is illustrated the entire apparatus of this invention. The apparatus comprises a packaging sheet loading unit A, a carrier unit B, a transfer unit C, an unpackaging unit D, a discharge unit E, a sheet housing unit F and a bulk sheet feeding mechanism unit G.

In this embodiment, a transfer direction of the packaging sheet is referred to as "forward", whereas the reverse direction is called "backward". This side in a crosswise direction is referred to as a "front side", while the opposite side is called a "rear side".

Figures 8A, 8B, 8C, 8D:
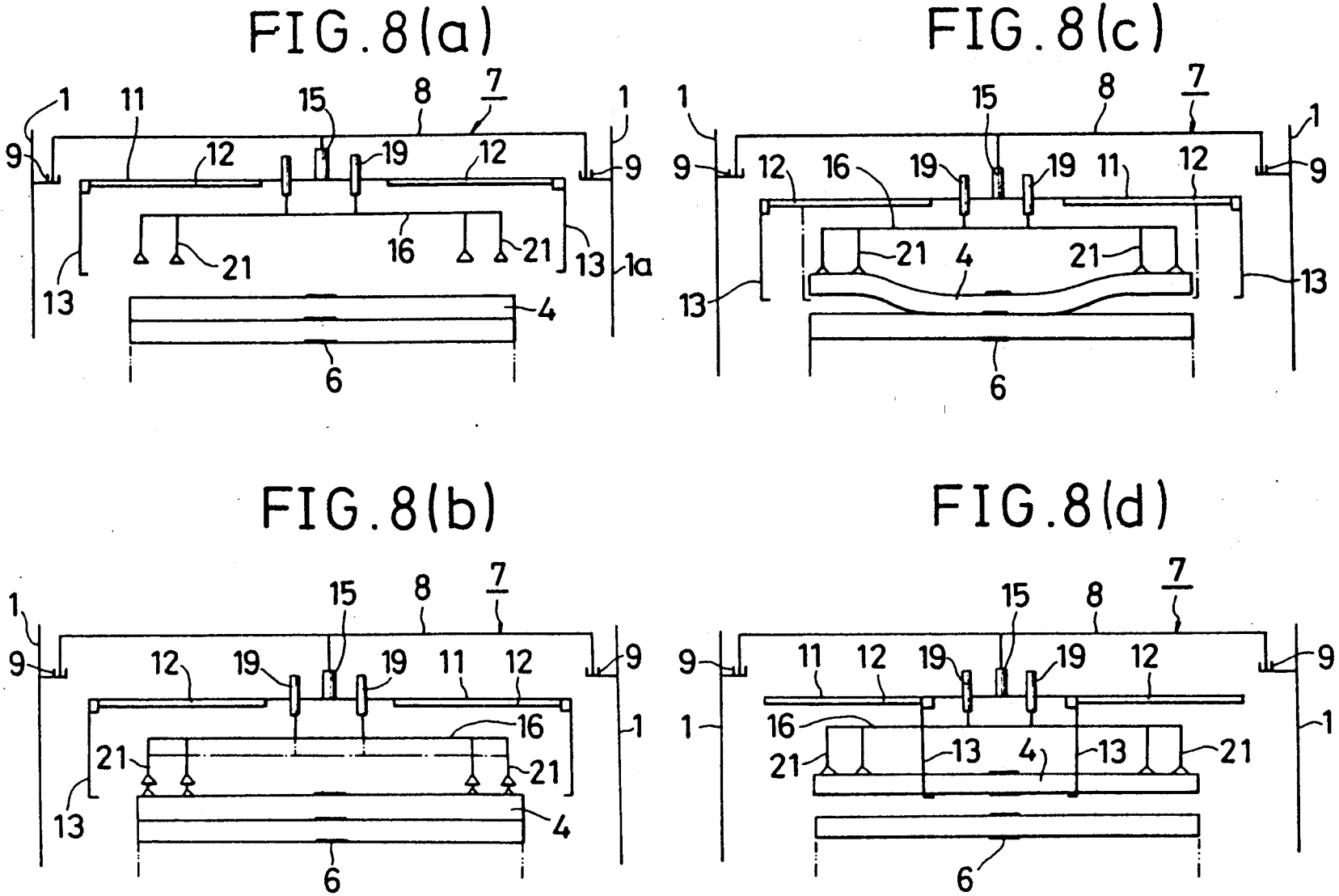
FIGS. 8(*a*) through 8(*d*) are schematic diagram of assistance in explaining states in which the carrier member adsorptively holds a packaging sheet.
Figure 9:
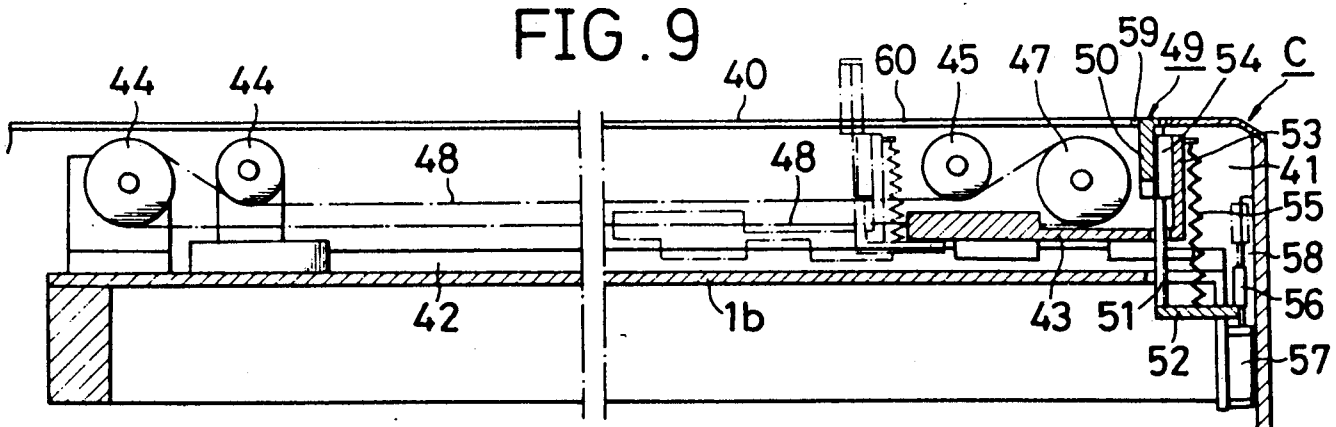
FIG. 9 is a plan view in vertical section, showing a transfer board.
Figure 10:
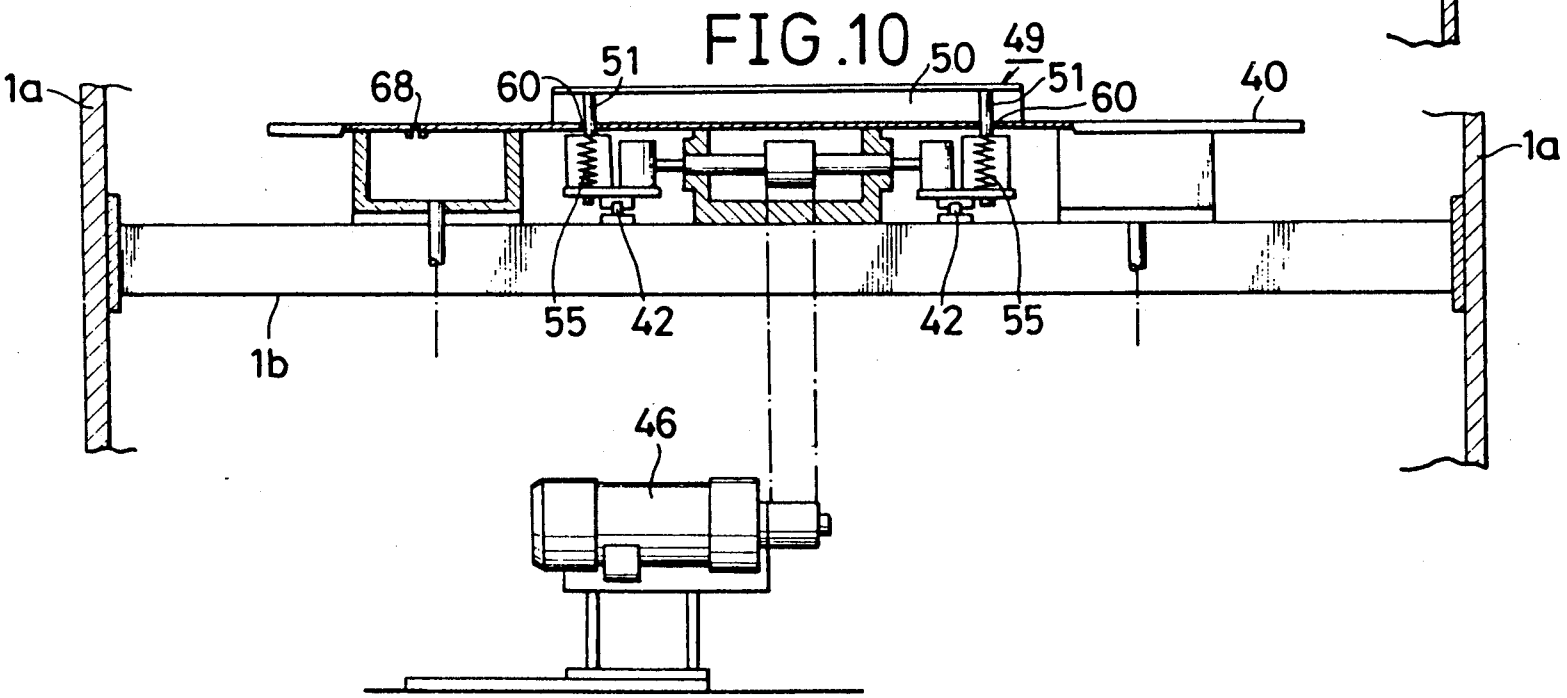
FIG. 10 is a side view in vertical section, illustrating the transfer board.
Figure 11:
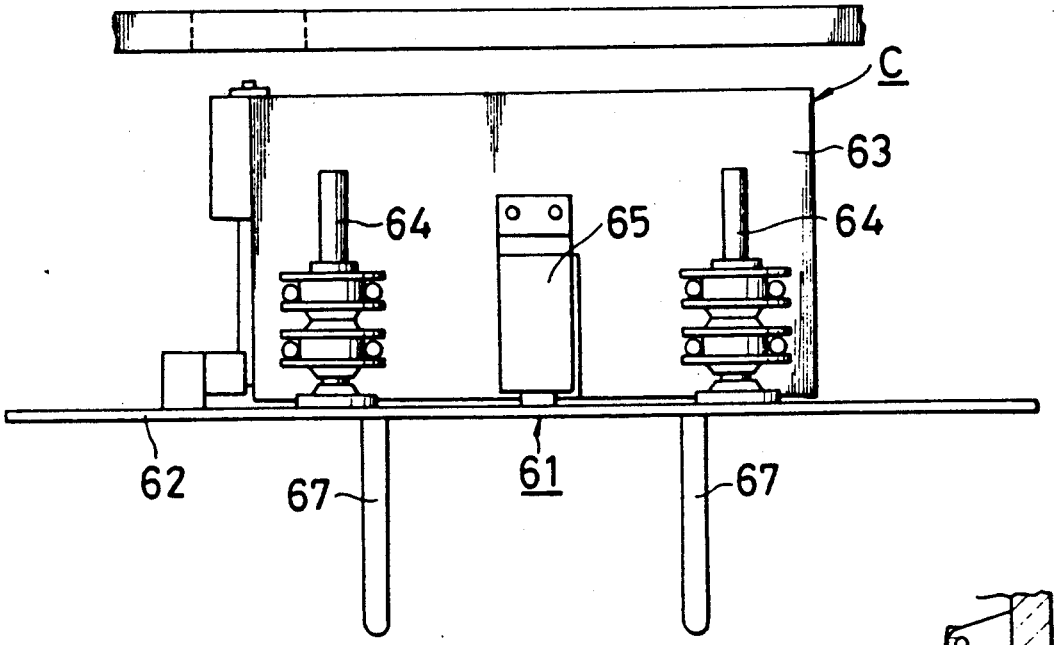
FIG. 11 is a plan view depicting a side guide operating mechanism.
Figure 12:
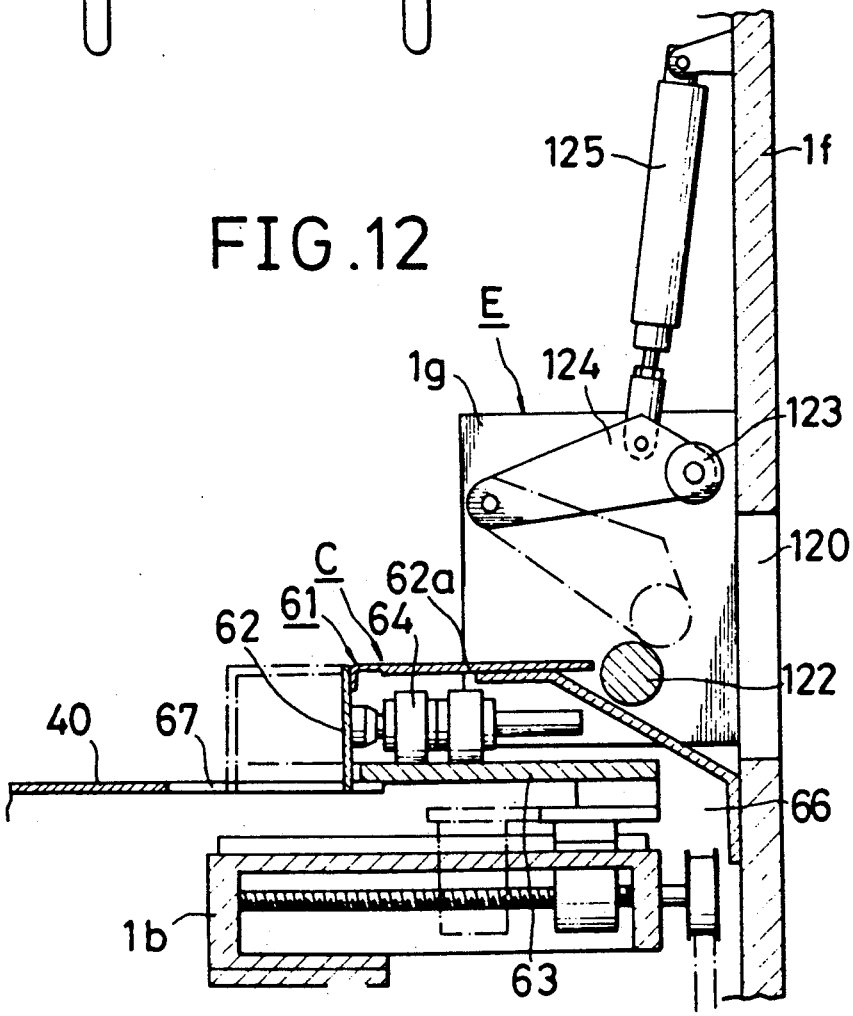
FIG. 12 is a side view in vertical section, illustrating the side guide operating mechanism and a discharge hole.
Figure 13:
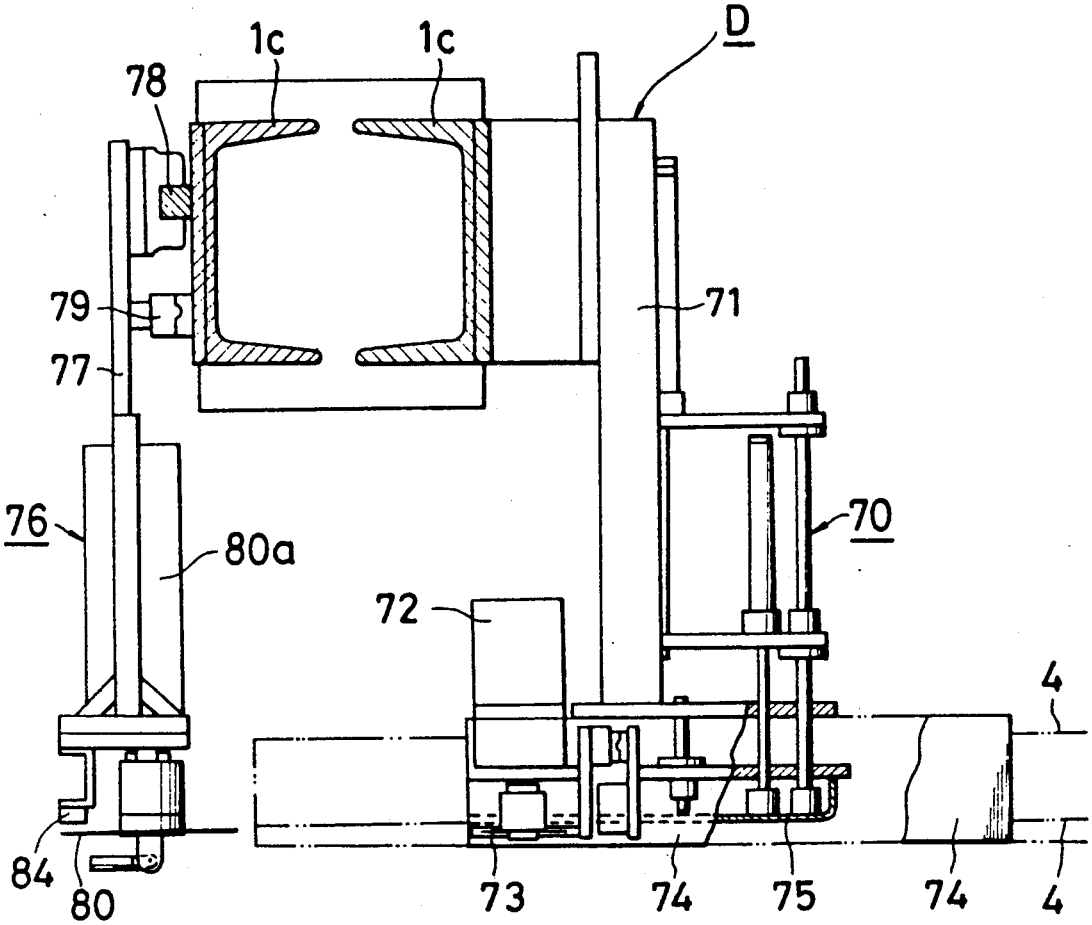
FIG. 13 is a partially cut-away front elevation showing side and front cutter mechanisms.

The packaging sheet loading unit A is constructed as follows. A lift table 2 is, as illustrated in FIG. 1, disposed inwardly of a machine frame body 1. The lift table 2 is suspended by chains 3 secured to four corners thereof. Packaging sheets 4 each containing a sheaf of sheets 5 are multistage-loaded on a pallet. The as-loaded packaging sheets 4 are placed on the lift table 2 by a forklift or the like. The packaging sheets 4 are lifted or lowered, keeping a horizontal state. At this time, a glue 6 is, as depicted in FIGS. 8(*a*)-(*d*), applied on the central part of each packaging sheet 4 loaded thereon. A load collapse of the packaging sheets 4 is thus prevented.

An arrangement of the carrier unit B will be described. As illustrated in FIGS. 3 through 8, a carrier member 7 is stretched between two machine frames 1*a* of the machine frame body 1, the frames 1*a* being provided on the front and rear sides thereof. The carrier member 7 has a 3-unit-based structure consisting of an upper frame body 8, a bar supporting member 11 and a sucker fitting member 16.

The upper frame body 8 is framed by side frames 8*a* provided on the rear and front sides, vertical frames 8*b* provided in back-and-forth directions and central frame 8*c*. A connecting plate 8*d* is stretched on the central frame 8*c*. Two side frames 8*a* are slidably fitted in rails 9 laid on the machine frames 1*a*. A shift air cylinder 10 is connected between one machine frame 1*a* and the side frames 8*a*. The side frames 8*a* are mounted so that the carrier member 7 is reciprocatively movable between the carrier unit B and the transfer unit C.

The bar supporting member 11 is framed by side frames 11*a*, vertical frames 11*b* and a central frame 11*c*. A connecting plate 11*d* is stretched on the central frame 11*c*. Installed between the connecting plate 11*d* and the side frames 11*a* are rodless cylinders 12 from which bar frame bodies 13 suspends. The bar frame body 13 framed in a rectangular shape includes a sheet holder bar 13*a* at its lower end. The bar frame bodies 13 are slidably fitted in rails 14 laid on lower faces of the vertical frames 11*b*. The two bar frame bodies 13 are so mounted as to be reciprocatively movable. The frame bodies 13 approach towards the central part from the ends by means of the rodless cylinders 12, or move away from the central part to the ends, simultaneously. The lifting/lowering air cylinder 15 mounted on the upper frame body 8 is linked to the bar supporting member 11. The bar supporting member 11 is installed to permit its lifting and lowering motions. The packaging sheet 4 is underslung-held by the sheet holder bars 13*a*.

Figure 6:
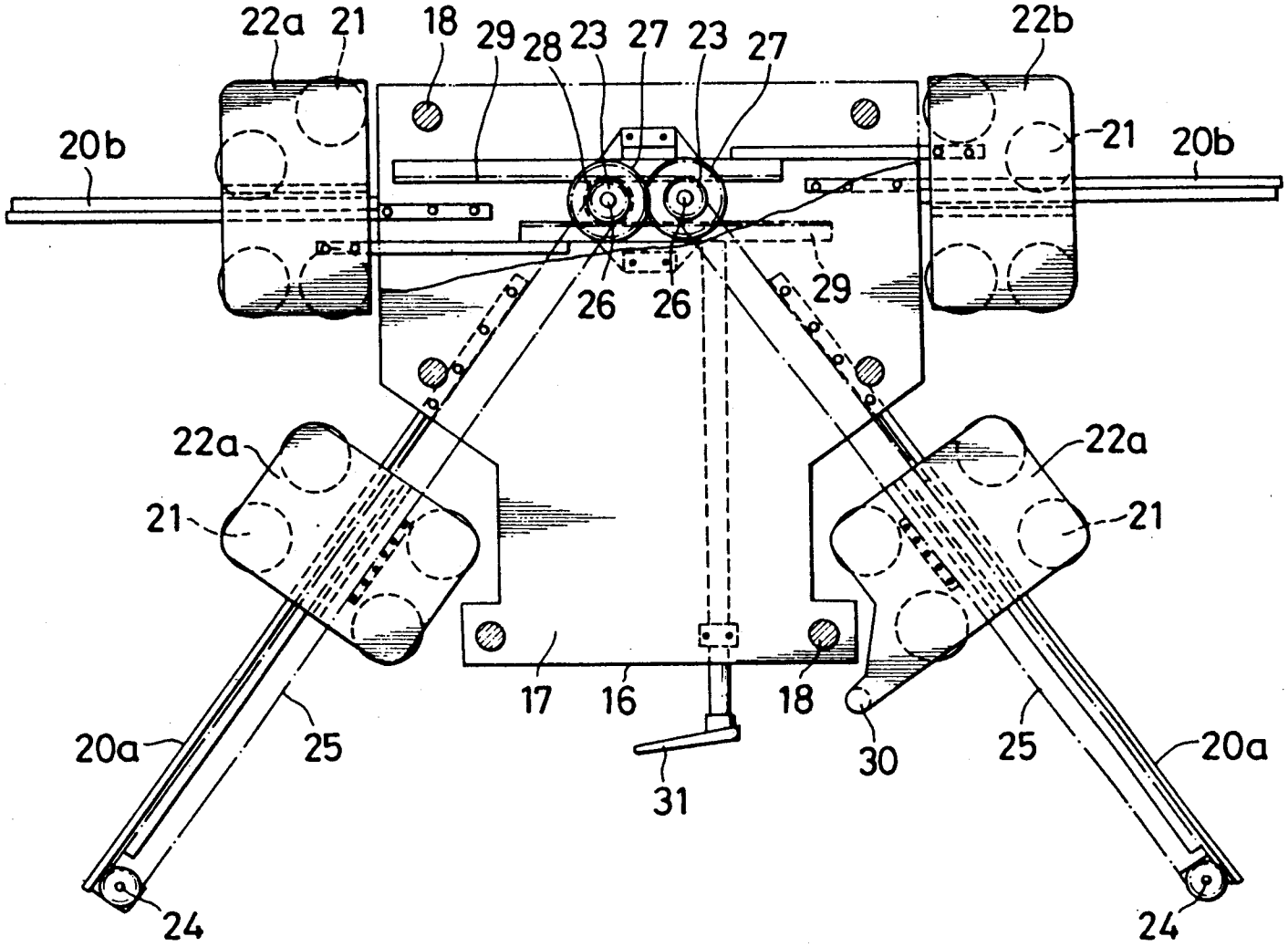
FIG. 6 is a plan view showing a sucker fitting member of the same carrier member.

The sucker fitting member 16 stands erect from a base 17. The sucker fitting member 16 is mounted under the bar supporting member 11 by a guide rod 18 penetrating the bar supporting member 11 and also the upper frame body 8. Linked to the sucker fitting member 16 is a lifting/lowering air cylinder 19 attached to the bar supporting member 11. Thus, the sucker fitting member 16 is so fitted as to be ascendable and descendable. The sucker fitting member 16, as depicted in FIG. 6, includes first guide rails 20*a* protruding therefrom. The first guide rails have their proximal ends pivotally fitted to the base 17 so that the rails 20*a* are openable and closable to assume a substantially V-shape. Second guide rails 20*b* protruding from the base 17 are provided on the right and left sides thereof. Sucker supporting members 22*a* and 22*b* are fitted with suckers 21 for adsorbing the packaging sheet 4. The sucker supporting members 22*a* and 22*b* are slidably disposed astride of the first and second guide rails 20*a* and 20*b*. Fitted pivotally to the distal and proximal ends of the first guide rails 20*a* are chain wheels 23 and 24 on which a chain belt 25 is wound. The chain belt 25 is connected to the sucker supporting member 22*a*. Gears 27, meshing with each other, are attached to pivotal shafts 26 of the chain wheels 23 pivotally fitted to the proximal ends of the first guide rails 20*a*. One pivotal shaft 26 is fitted with a pinion 28 engaging with racks 29, 29 slidably mounted on the base 17. The two racks 29, 29 are connected to the sucker supporting members 22*b*. A handle 30 is moved corresponding to a size of the packaging sheet 4. The other sucker supporting members 22*a* are thereby moved via the gears 27 and the chain belt 25 integral with the sucker supporting members 21*a*. The sucker supporting members 22*b* are moved by the two racks 29 which slides with rotations of the pinion 28. As a result, the sucker supporting members 22*a* and 22*b* move so that these members 22*a* and 22*b* simultaneously expand outwards or contract inwards. The suckers 21 adsorb the four corners of the packaging sheet 4 to raise it.

The transfer unit C incorporates, as shown in FIGS. 9 through 12, a flat transfer board 40 mounted with a sheet push operating mechanism 41 and a side guide operating mechanism 61.

The sheet push operating mechanism 41 is constructed as follows. Two lengths of parallel rails 42 are laid on the lower machine frame 1*b* under the transfer board 40. A sheet push board 43 is provided on the rails 42. Driven wheels 44 and 45 are installed in front and in rear of the rails 42. Attached to the rear part of the rails 42 is a driving wheel 47 rotated by a driving motor 46 mounted on the machine frame 1*b*. A belt 48 is wound on the driven wheels 44, 45 and on the driving wheel 47. The belt 48 is fixedly connected to the sheet push board 43 to thereby slidably drive it. A sheet push member 49 is vertically provided at a rear part of the sheet push board 43. A supporting rod 51 hanging on the sheet push member 49 closely to the both ends of a sheet contact plate 50 formed in a rectangular configuration. The sheet push member 49 is slidably mounted on the sheet push board 43. A stopper piece 52 protruding from a rear end of the sheet push board 43 is provided in continuation from the lower end of the supporting rod 51. A rising piece 53 is provided at the rear end of the sheet push board 43. There is also provided a guide piece 54 for guiding the supporting rod 51 of the sheet push member 49. A coil spring 55 is interposed between the upper end of the rising piece 53 and the stopper piece 52 to thereby bias the sheet push member 49 upwards constantly. To hold the sheet push member 49 in a lower position resisting a tensile force of the coil spring 55, a space unit of the machine frame 1*b* behind the transfer board 40 accommodates a stopper 56 engaging with the stopper piece 52, an air cylinder 57 for operating the stopper 56 and a guide rail 58. The end part of the transfer board 40 on the side of the carrier unit B is bored with a slot 59 corresponding to the sheet push member 49 retractable into this slot 59. Formed in parallel in the longitudinal direction are shift holes 60, 60 into which the supporting rods are slidably fitted, whereby the sheet push member 49 is shiftable while being protruded. The packaging sheet 4 or the packaged sheets 5 carried by the transfer board 40 are pushed by the sheet push member 49, thus moving them forward.

The side guide operating mechanisms 61 are disposed on the rear and front sides of the transfer board 40. A guide rod 64 and an air cylinder 65 for fine adjustment are mounted on the bottom plate 63 on the rear face side of the side guide plate 62. Connected is a bottom plate shifting means 66 consisting of guide rails laid on the machine frame 1*b* disposed under the bottom plate 63. The side guide plates 62 are fitted into notch holes 67 notched in two side portions of the transfer board 40. The side guide plates 62 are so adjusted that the plates 62 can be expanded and narrowed from both sides in accordance with a size of the packaging sheet 4 by two-stage operations of the bottom plate shifting means 66 and the air cylinder 65. Note that an upper face of each side plate 62 is covered with a cover 62*a* to smoothly guide the empty packaging sheet 4 discharged from a discharge hole (which will be mentioned later) positioned upwardly of the plate 62.

Besides, the transfer board 40 is formed with air blowout holes 68 for smoothing the transfer of the packaging sheet 4, the holes 68 spreading over the entire surface thereof.

The unpacking unit D comprises, as illustrated in FIGS. 13 through 16, a side cutter mechanism 70 provided at the top end of the transfer board 40, a front cutter mechanism 76, an upper unpackaging mechanism 85, a lower unpackaging mechanism 93 and a sheet removing mechanism 103.

The side cutter mechanism 70 is constructed as follows. Side cutters 73 rotationally driven by driving motors 72 are disposed on both sides of the lower end of a supporting frame 71 attached to the machine frame 1*c* for linking the front side machine frame 1*b* and the rear side machine frame 1*b*. The two side cutters 73 are so attached as to be movable simultaneously towards the central part or away from each other towards the front and rear sides by means of a gear transmission device. A width corresponding to the size of the packaging sheet 4 is thus adjusted while expanding or narrowing it. The side cutters 73 each have guide plates provided inside to confront each other. The guide plates 74 serve to hold two side faces of the packaging sheet 4. A presser plate 75 for pressing the upper face of the packaging sheet 4 is provided inwardly of the guide plate 74, the presser plate 75 being adjustable up and down. When being surely led between the two side cutters 73, both side faces of the packaging sheet 4 is cut open by the side cutters 73 whose cutting edges protrude from the guide plates 74.

Figure 14:
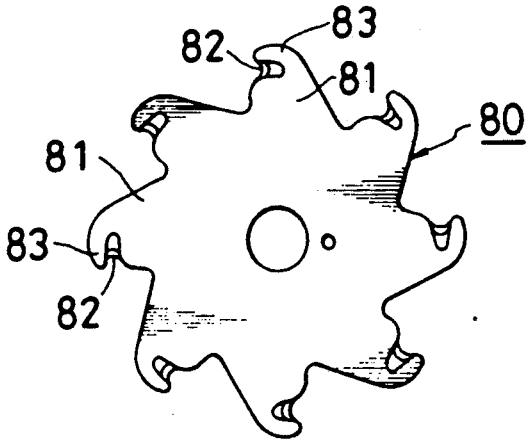
FIG. 14 is a plan view showing a front cutter.
Figure 15:
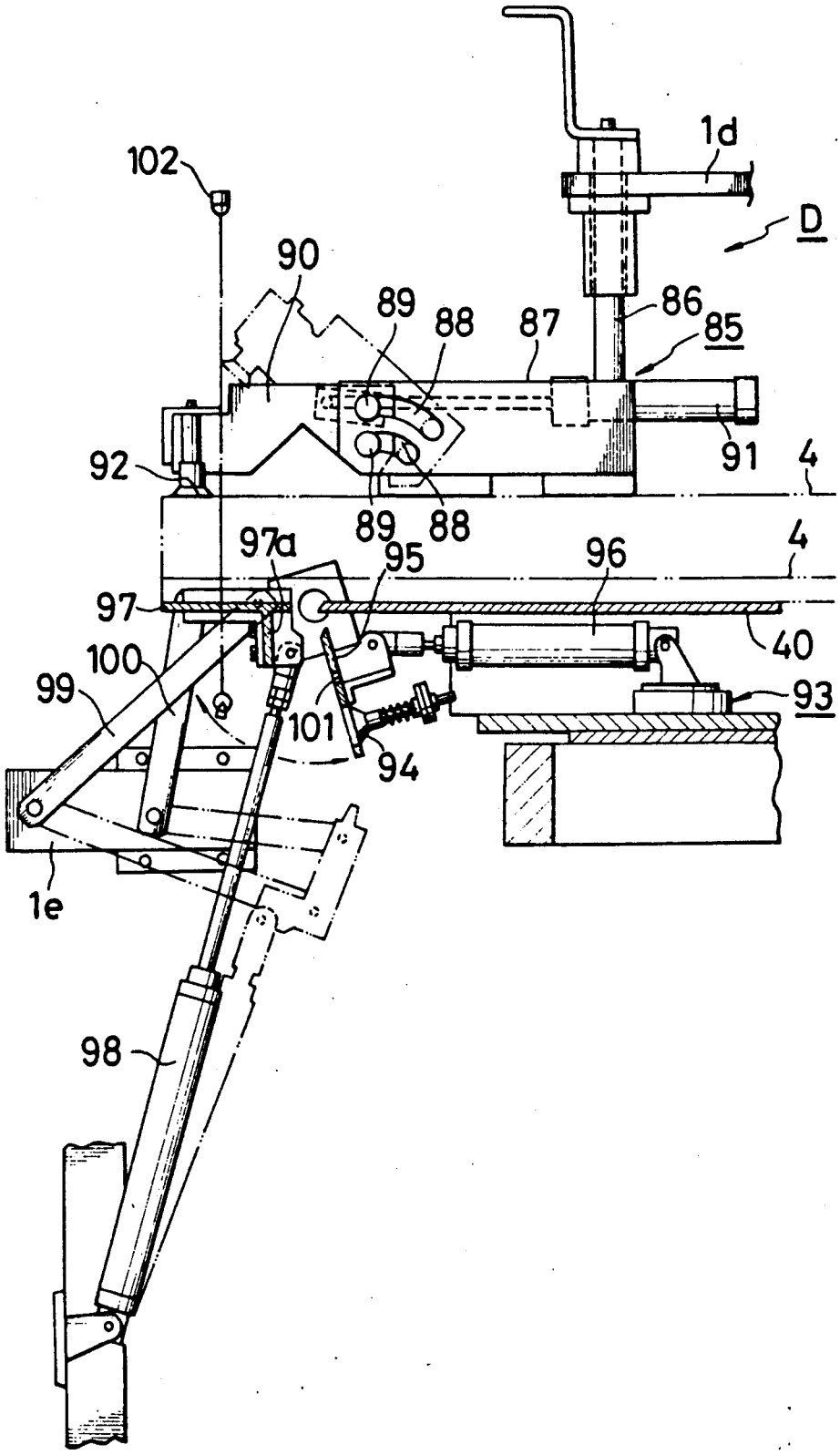
FIG. 15 is a front elevation in vertical section, illustrating upper and lower unpackaging mechanisms.
Figure 16:
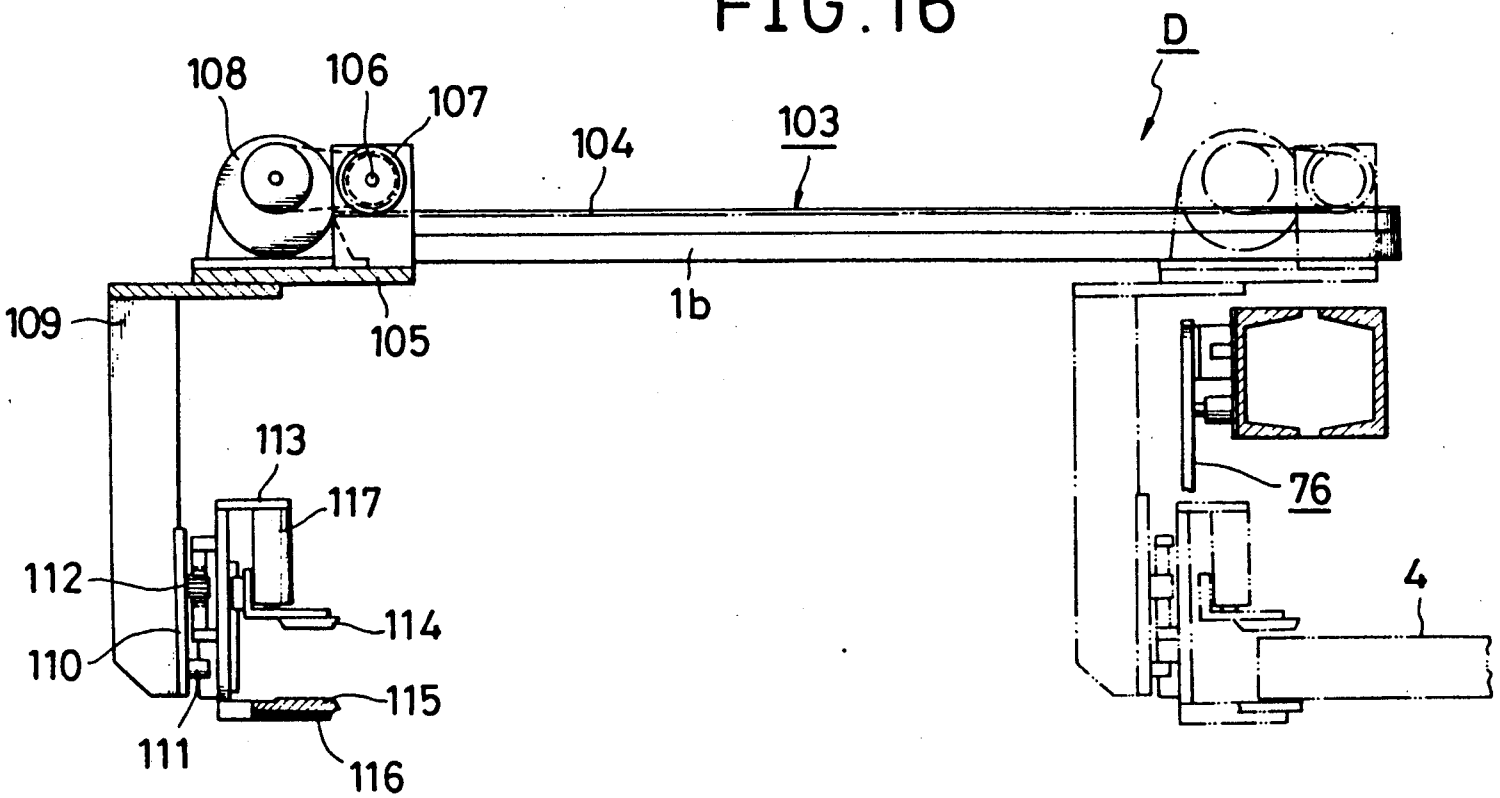
FIG. 16 is a partially cut-away front elevation showing a sheet removing mechanism.
Figure 17:
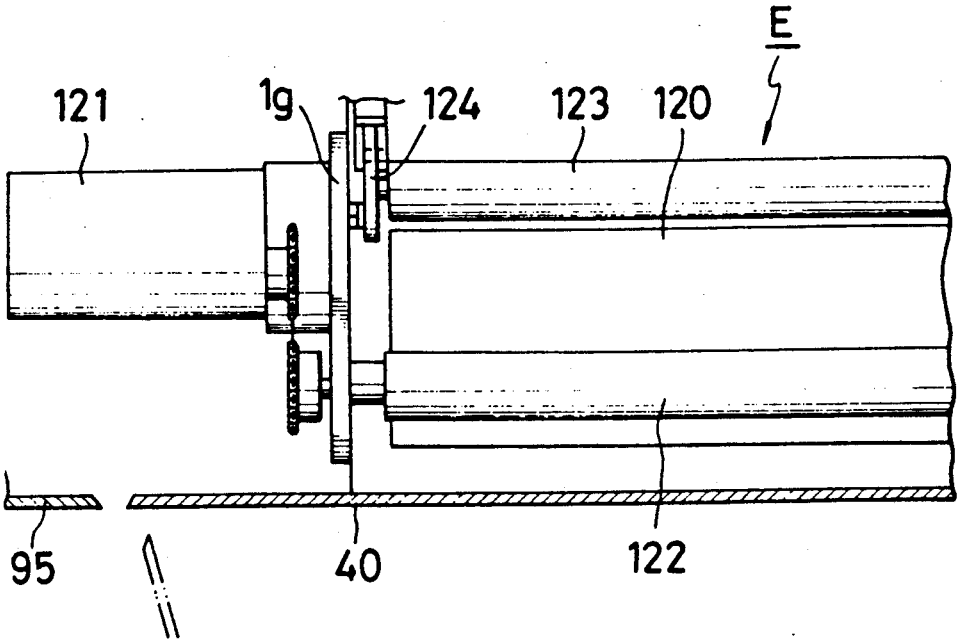
FIG. 17 is a front elevation depicting the discharge hole.
Figure 19:
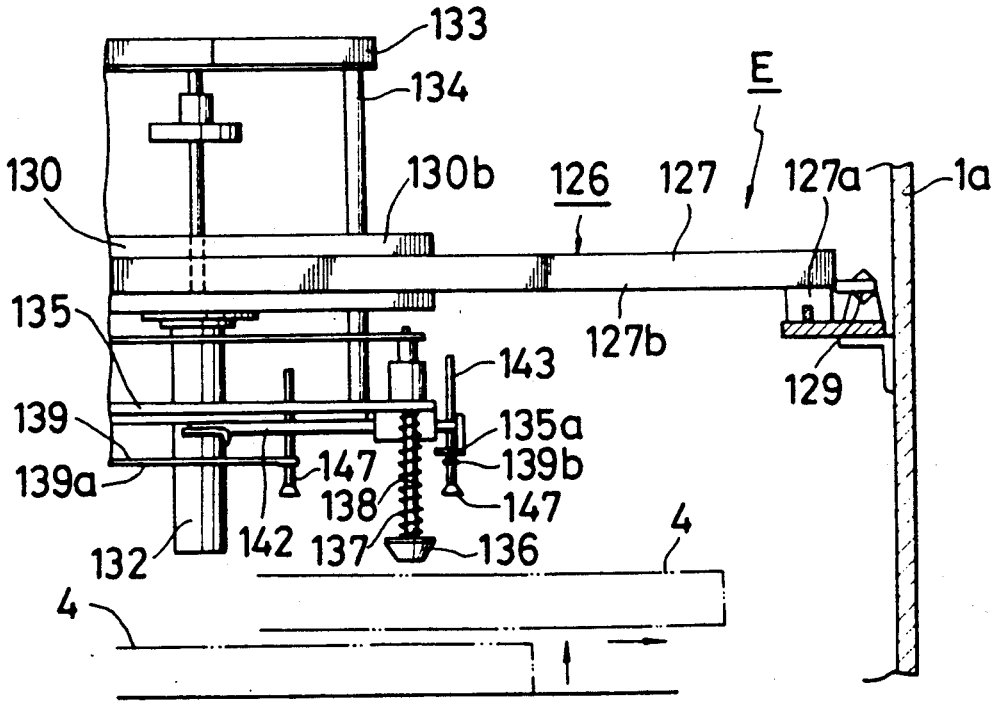
FIG. 19 is a side view showing a half of the packaging sheet lifting/shifting mechanism on the rear side.
Figure 18:
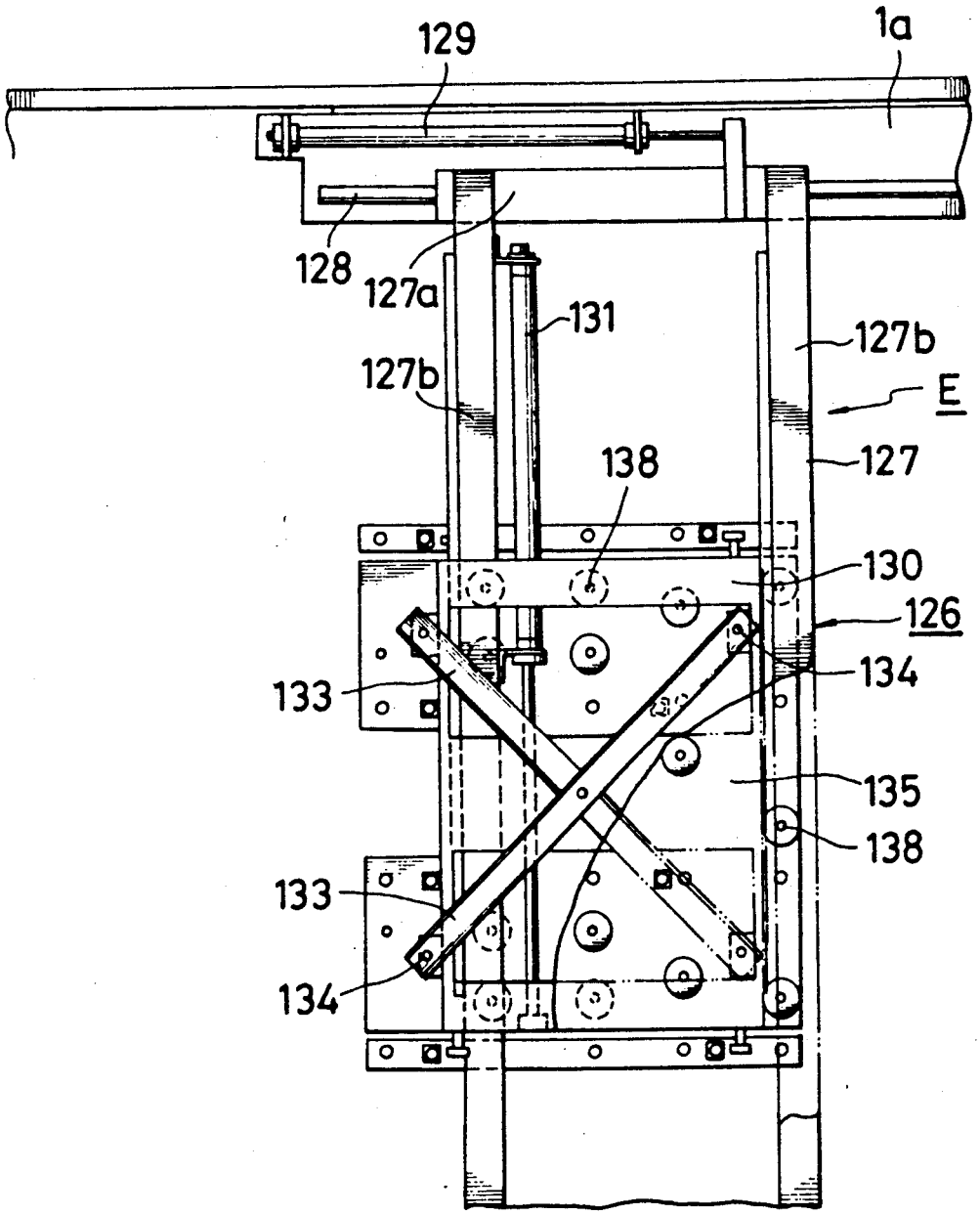
FIG. 18 is a partially cut-away plan view showing a packaging sheet lifting/shifting mechanism.
Figure 20:
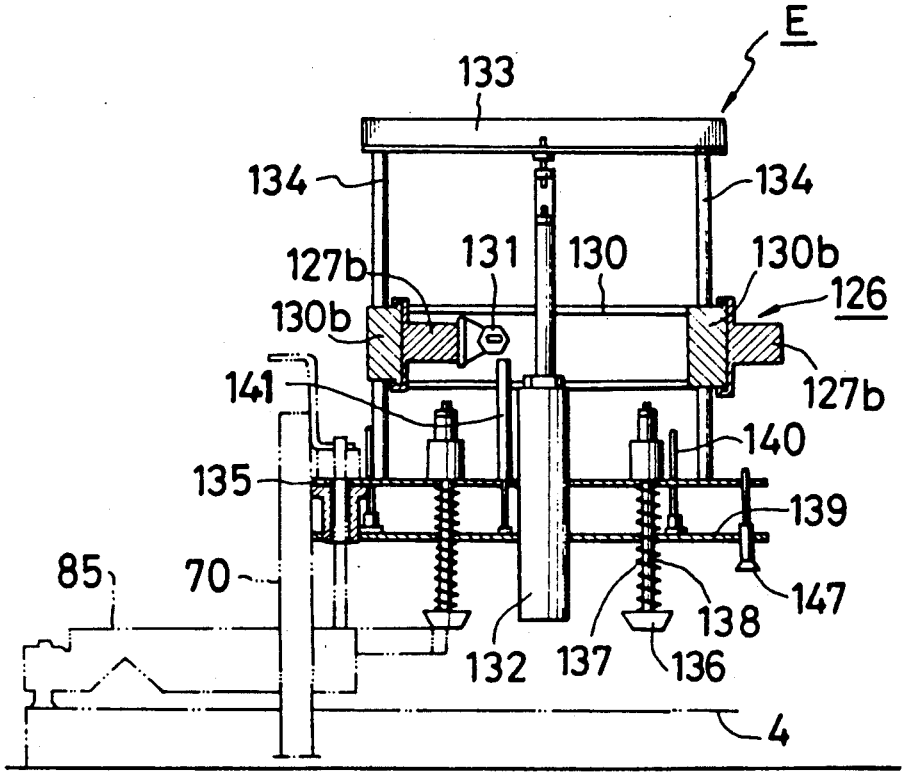
FIG. 20 is a front elevation in vertical section, showing the same packaging sheet lifting/shifting mechanism.
Figure 21:
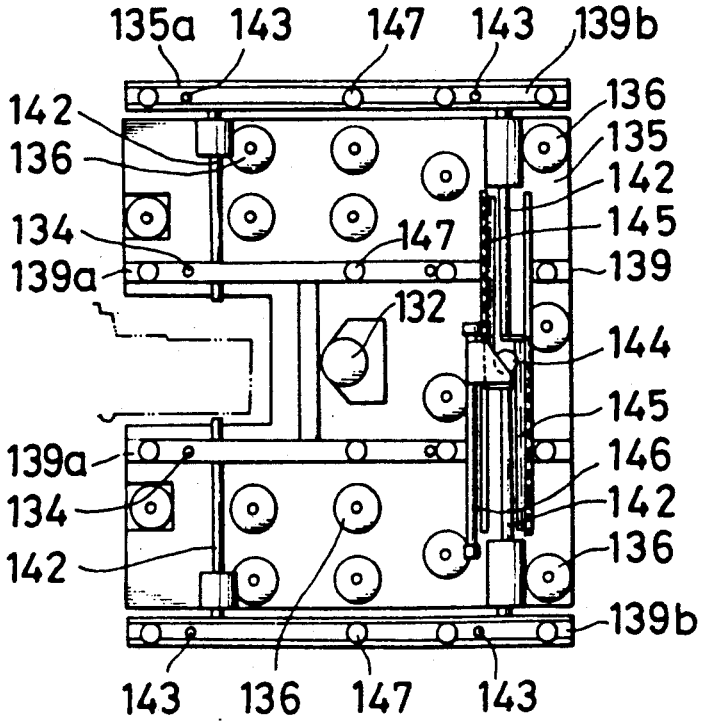
FIG. 21 is a rear view showing a shift frame body of the same packaging sheet lifting/shifting mechanism.

The front cutter mechanism 76 is arranged as follows. An upper end of supporting arm 77 is slidably fitted to a guide rail 78 extending from the front side of the machine frame 1*c* to the rear side thereof. A rodless cylinder 79 is also attached to the machine frame 1*c*. The supporting arm 77 is driven to traverse the front face of the packaging sheet 4. Provided at the lower end of the supporting arm 77 are a rotation detecting sensor 84 and a front cutter 80 rotatably connected to an intermittent rotary device 80*a* such as a driving motor or a ratchet mechanism (the driving motor in this embodiment). As depicted in FIG. 14, the front cutter 80 includes cut-open edge pieces 81 projecting in radial directions and each assuming a vertical triangular shape so that the cutter 80 is equally divided into, e.g., eight segments in the peripheral direction. Each cut-open edge piece 81 is formed with a substantially U-shaped recess open in the same peripheral direction. A cutting edge 82 is thus formed. Safety guide members 83 are formed along the outer periphery thereof. The safety guide members 83 prevent the internal sheets 5 from being damaged by the cutter 80 when cutting open the front portion of the packaging sheet 4 with the cutting edges 82 without rotating the front cutter 80. The rotation detecting sensor 84 causes each of the cut-open edge pieces 81 of the front cutter 80 to certainly stop in a predetermined rotary position every time the packaging sheet 4 is completely cut open by the front cutter 80 which makes a ⅛ intermittent rotation with the aid of an intermittent rotary device 80*a*.

The upper unpackaging mechanism 85 is arranged in the following manner. A fixing member 87 is so fitted via a connecting rod 86 to the machine frame 1*d* as to be vertically adjustable. A pin 89 is loosely fitted into a fan-shaped hole 88 of the fixing member 87. A thus arranged rotary arm 90 is so mounted as to be movable up and down by an air cylinder 91. The top end of the arm 90 is attached with suckers 92, directed downwards, for adsorbing the packaging sheet to upwardly unpackage the upper half of the packaging sheet 4.

The following is a description of the lower unpackaging mechanism 93. A receiving board 95 is provided with suckers 94, directed upwards. The receiving board 95 is so pivotally fitted to the top end of the transfer board 40 so as to be rotatable by an air cylinder 96 from a horizontal direction towards a lower rear side, making an obtuse angle greater than 90°. The lower half of the packaging sheet 4 is thus unpackaged downwards. There is also disposed a sheet receiving plate 97 for receiving the sheets 5 set in the unpackaged packaging sheet 4. The sheet receiving plate 97 has a downwardly bent piece 97*a* to which an air cylinder 98 is connected. Connecting rods 99 and 100 are pivotally fitted to the top end of the sheet receiving plate 97 and to the proximal end of the downwardly bent piece 97*a*. The other ends of the connecting rods 99 and 100 are pivotally fitted to the machine frame 1*e*, thus constituting a link mechanism. Corresponding to stretching/contracting motions of the air cylinder 98, the sheet receiving plate 97 is rotated horizontally to the top end position of the transfer board 40 or downwardly of a rotary trajectory of the receiving board 95. Furthermore, the receiving board 95 is bored with a slot 101 extending towards the front and rear sides. A photo sensor device 102 is disposed to enable transmission via the slot 101 in the vertical, front and rear directions of the lower unpackaging mechanism 93. The photo sensor device 102 effects a detection to cause the top end of the transferred packaging sheet 4 to certainly stop in a predetermined position.

An arrangement of the sheet removing mechanism 103 will be explained. Racks 104 set in the to-and-fro directions are mounted on the machine frames 1*b* on the front and rear sides. Engaged with the racks 104 are pinions 107 attached to both ends of a rotary shaft 106 pivotally fitted to a bearing plate 105. The rotary shaft 106 is driven by a driving motor 108 mounted on the bearing plate 105. The pinions 107 of the bearing plate 105 are engaged with the racks 104 and rotated by rotational driving forces of the driving motor 108. The bearing plate 105 is thereby reciprocated in the to-and-fro directions of the transfer board 40. Suspended from the bearing plate 105 are two lengths of arms 109 spaced away from each other in the front-and-rear directions. Lower ends of the two arms 109 are connected together via a connecting plate 110. Two pieces of seizing members 113 are slidably fitted at a spacing to a guide rail 111 laid on the connecting plate 110 to extend in the front-and-rear directions. The seizing members 113 are also pivotally fitted to the connecting plate 110 to engage with pinions. By use of an spacing adjusting mechanism 112 composed of upper and lower racks connected to the seizing members 113, the two seizing members 113 are made to simultaneously approach or move away from each other corresponding to a size of the sheet 5. Each seizing member 113 includes a lower seizing piece 115 projecting from its lower end. The lower seizing piece 115 is formed with air ejection holes 116 for ejecting the air to surely separate the sheets 5 from the sheet receiving plate 97. The seizing member 113 is fitted with an upper seizing piece 114 opposite to the lower seizing piece 115. The upper seizing piece 114 is movable up and down by an air cylinder 117, thus seizing the sheets 5.

The discharge unit E operates as follows. As illustrated in FIGS. 12 through 17 and 21, the discharge unit E includes a rectangular discharge hole 120 bored in a side plate 1*f* provided on the upper machine frame body 1 above the side guide plate 62 on the rear side of the transfer board 40. At a lower part in an interior of the discharge hole 120, a driving roller 122 rotationally driven by a driving motor 121 is pivotally fitted to a wall plate 1*g* protruding from the side plate 1*f*. Above the driving roller 122, a driven roller 123 opposite to the driving roller 122 is pivotally fitted to one end of an arm 124. The other end of the arm 124 is pivotally fitted to the wall plate 1*g*. The arm 124 is connected to an air cylinder 125. The driven roller 123 is so attached as to approach or move away from the driving roller 122. The [illegible] packaging sheet 4 is seized and then discharg[illegible] A packaging sheet raising/shifting mechanism 126 is disposed between the front and rear machine frames 1*a*. This mechanism 126 has a 4-unit-based structure consisting of a base frame body 127, a shift frame body 130, a pat fitting plate member 135 and a sucker fitting member 139.

The base frame body 127 is framed by side frames 127*a* and vertical frames 127*b*. The side frames 127*a* are slidably fitted to a rail 128 laid on the machine frame 1*a*. The machine frame 1*a* is connected via an air cylinder 129 to the side frames 127*a*. The packaging sheet raising/shifting mechanism 126 is so mounted as to movable from the unpackaging unit D to the discharge unit E behind it.

A shift frame body 130 is framed by vertical frames 130*b* and side frames 130*a* vertically provided and connected to both ends of the vertical frames 130*b*. The vertical frames 130 of the shift frame body 130 are slidably fitted to the vertical frames 127*b* of the base frame body 127. The air cylinder 131 attached to the vertical frames 127*b* is connected to the vertical frames 130*b*. The shift frame body 130 is so mounted as to be movable from the central part of the transfer board 40 to the discharge hole 120. An air cylinder 132 is mounted on a connecting plate 130*c* attached to the central part of the of the vertical frames 130*b* of the shift frame body 130. The pat fitting plate member 135 is vertically movably connected via a connecting rod 133 and a guide rod 134.

Pats 136 for holding the empty packaging sheet 4 at the lower end are scattered over the entire surface of the pat fitting plate member 135. Press rods 138 bias the pats 136 downward with the aid of a spring 137. The press rods 138 vertically movably attached operate to depress the empty packaging sheet 4.

The sucker fitting member 139 is composed of an H-framed frame body 139*a* and shift plates 139*b* disposed on the front-and-rear sides thereof. The frame body 139*a* is vertically movably connected to a lower part of the pat fitting plate member 135 through a guide rod 140 and an air cylinder 141. The shift plates 139*b* are vertically movably connected through guide rods 143 to lower parts of auxiliary plates 135*a*. The auxiliary plates 135*a* are connected to the front-and-rear side portions of the pat fitting member 135 via guide rods 142 attached to the pat fitting plate member 135. Besides, racks 145 are provided on both sides of a pinion 144 rotatably pivotally fitted and each engage with this pinion 144. The racks 145 are slidably attached to the lower face of the pat fitting plate member 135. One rack 145 is connected to a rodless cylinder 146. The two racks 145 are attached to the guide rods 142. The shift plates 139*b* are so mounted as to be simultaneously stretchable and contractible in accordance with the size of the packaging sheet 4 on the front-and-rear sides of the frame body 139*a* by driving the rodless cylinder 146 via the auxiliary plates 135*a*. Suckers 147 for absorbing the empty packaging sheet 4 are attached at spacings to the frame body 139*a* and the shift plate 139*b*.

The sheet housing unit F has a lift table which is, as in the case of the packaging sheet loading unit A, retained by chains. The lift table is loaded with a carrier pallet. The sheet housing unit F further incorporates, as illustrated in FIGS. 22 to 25, a sheet presser mechanism 150 and sheet rearranging mechanisms 157.

The sheet presser mechanism 150 is provided on a side wall face 1*h* at the front top end of the transfer board 40. A receiving board 152 is mounted on a supporting member 151 standing erect from a machine frame 1*i* so that the receiving board 152 is movable up and down by an air cylinder 153 and a guide rod (not shown). Moreover, a shift board 154 is slidably mounted on the receiving board 152. The shift board 154 is also horizontally movable by an air cylinder 155. A sheet presser piece 156 provided on an upper end of the shift board 154 is so fitted as to be retractable from the side wall face 1*h*. The sheet presser piece 156 is pulled out to press-stop an upward movement of the sheets 5 laminated on the carrier pallet.

Figure 22:
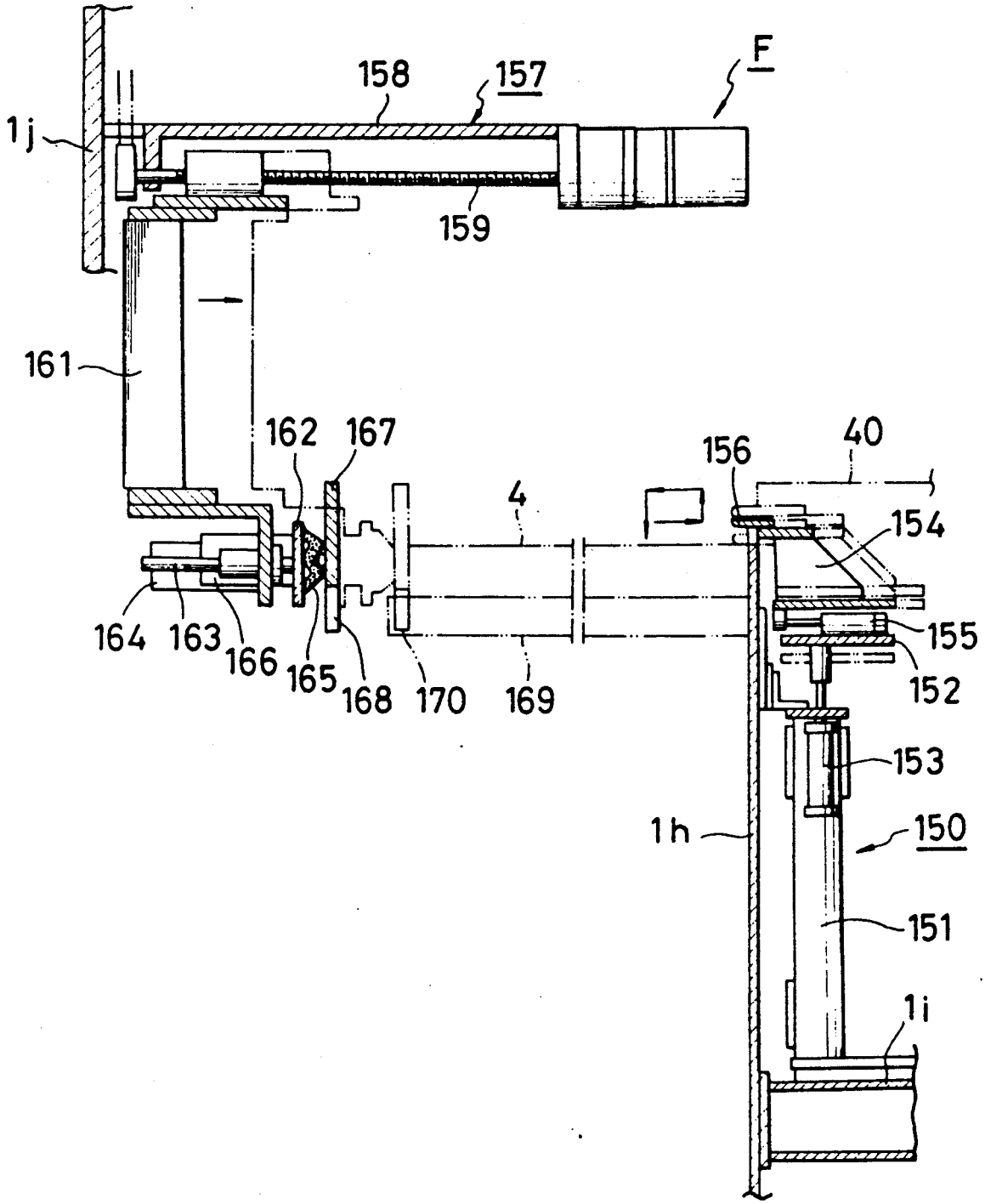
FIG. 22 is a front elevation in vertical section, showing a sheet press mechanism and a sheet rearranging mechanism.
Figure 23:
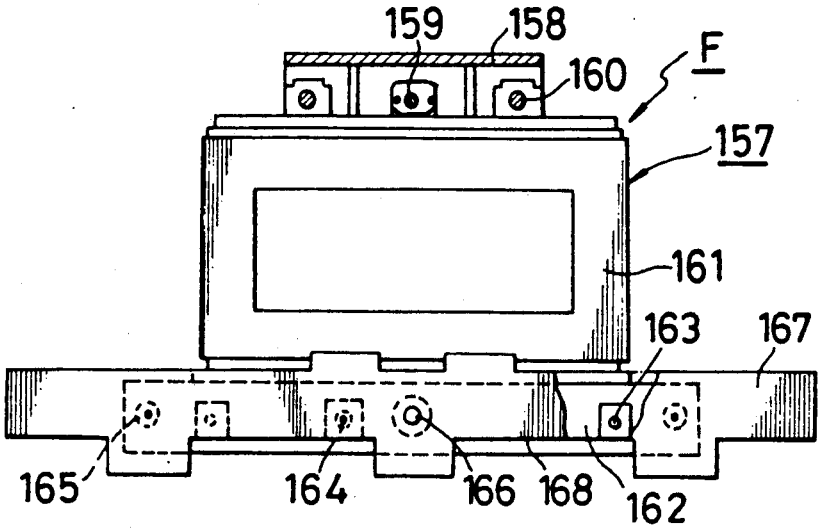
FIG. 23 is a side view in vertical section, illustrating the sheet rearranging mechanism.
Figure 24:
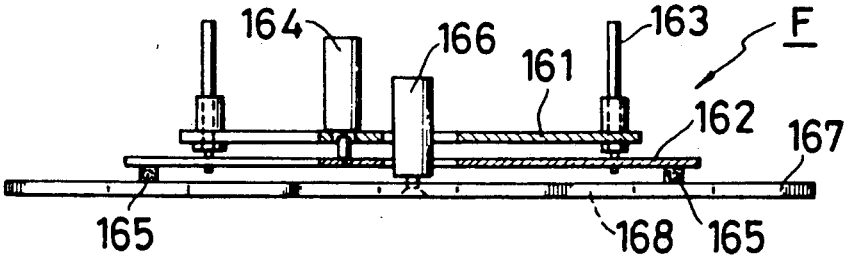
FIG. 24 is a plan view in cross section, illustrating the sheet rearranging mechanism.
Figure 25:
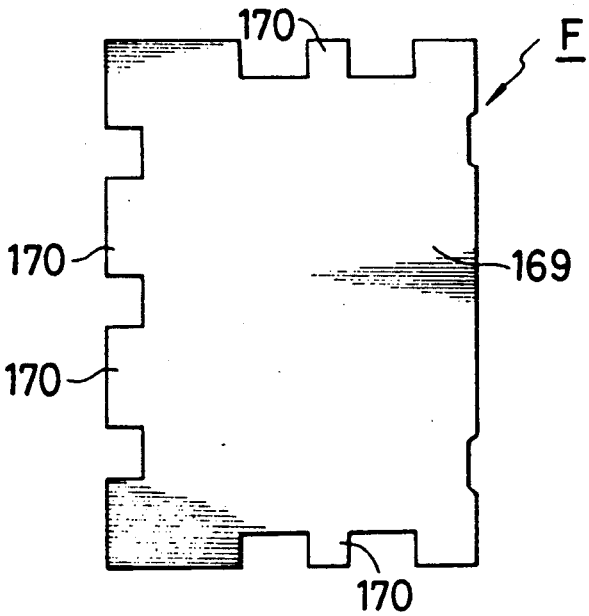
FIG. 25 is a plan view showing a bottom plate.

The sheet rearranging mechanisms 157 are, as depicted in FIG. 22, provided on three portions, i.e., to a wall face 1*j* confronting the sheet presser mechanism 150 and front-and-rear side wall faces 1*k*. The sheet rearranging mechanism 157 is provided with a screw rod and a guide rod in parallel with the rod 159. The screw rod 159 is rotationally driven on a protruded plate 158 protruding from the wall face 1*j*. An upper end of a supporting member 161 is screw-fitted to the screw rod. The supporting member 161 is also slidably fitted to the guide rod 160. The supporting member 161 is so attached as to be movable back and forth by rotational driving of the screw rod 159. An adjusting plate 162 is attached to the lower end of the supporting member 161 so that the plate 162 is able to advance and retreat on the front side of the supporting member 161 with the help of the guide rod 163 and the air cylinder 164. An impingement plate 167 is attached through a buffer elastic material 165 such as rubber to the front face of the adjusting plate 162. A vibrator 166 is connected to the impingement plate 167 the lower end of which is formed with a rugged portion including notches 168 at intervals. A bottom plate 169 for loading the sheets 5 is placed on the carrier pallet disposed on the lift table incorporated in the sheet housing unit F. Formed along the circumference of the bottom plate 169 is a rugged portion including protrusions 170 fitted into the notches 168. The uneven sheets 5 are rearranged by impinging the impingement plate 167 thereon by operating the vibrator 166.

An upper part of the sheet presser mechanism 150 on the front and rear sides are bored with air ejection slots 171 for blowing the air to separate the sheets 5 from each other.

Figure 26:
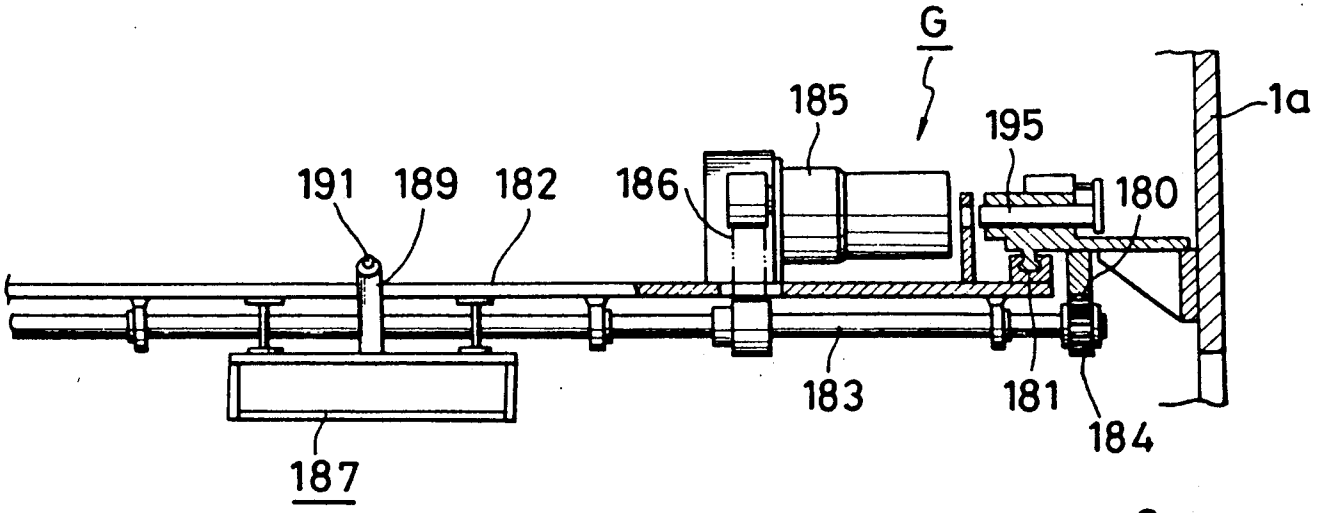
FIG. 26 is a partially cut-away side view illustrating a bulk sheet feed mechanism.
Figure 27:
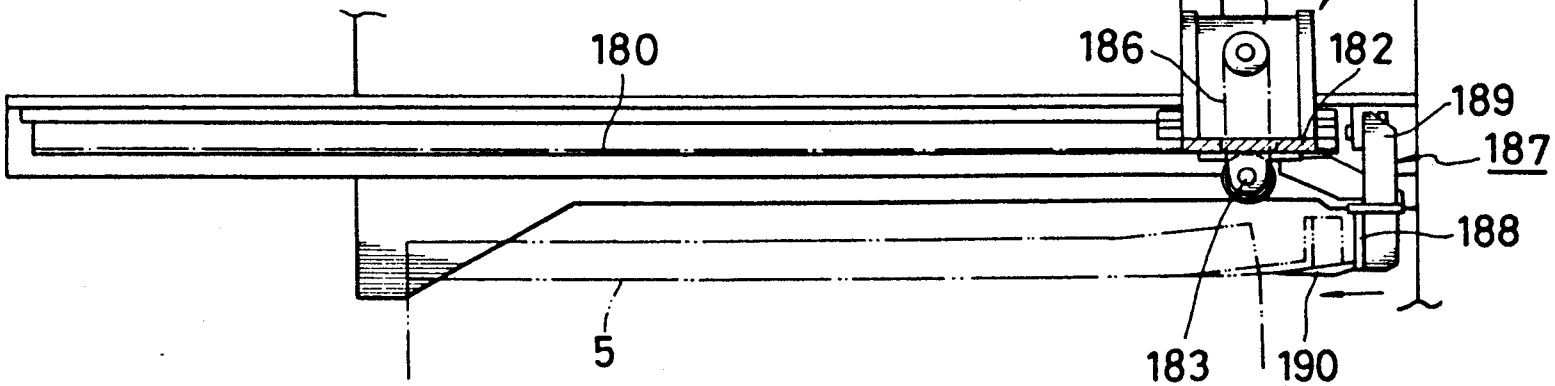
FIG. 27 is a front elevation in vertical section, illustrating the bulk sheet feed mechanism.
Figure 28:
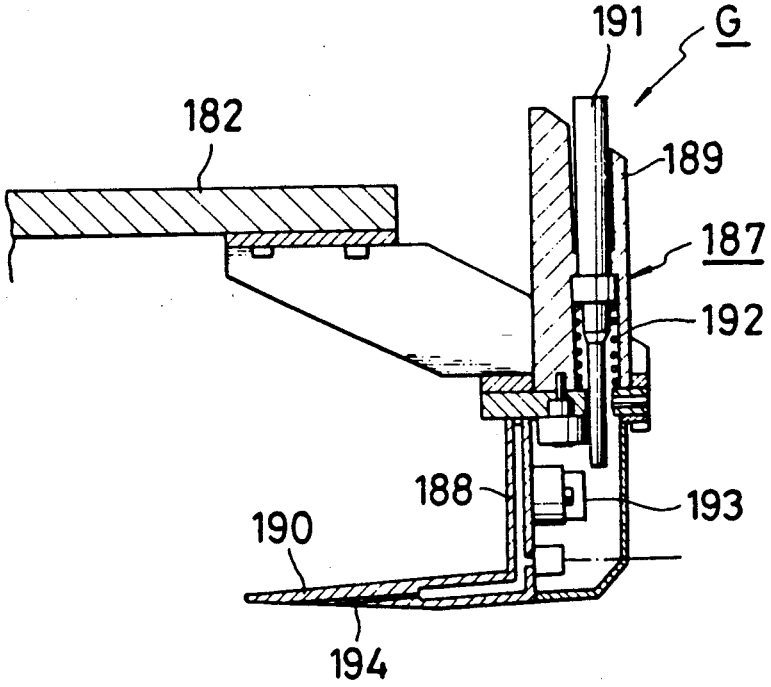
FIG. 28 is a front elevation in vertical section, showing a sheet press member of the bulk sheet feed mechanism.

The bulk sheet feed mechanism G is, as illustrated in FIGS. 26 through 28, disposed downwardly in parallel with the carrier unit B. The mechanism G is employed for preventing paper adhesion with a printing ink after printing has been effected on, e.g., one side of the double-side printing sheet 5. The mechanism G is also used when blowing the air in between the sheets before performing back side printing to promote the sheet separation. A construction of the mechanism G is as follows. A rack 180 and guide rails 181 are provided in parallel in the to-and-fro directions downwardly, confronting the entire surfaces of the two machine frames 1*a*. A supporting crossbeam 182 extending to slidably fit to the two guide rails 181. Engaged with the rack 180 is a pinion 184 attached to a rotary shaft 183 rotatably pivotally fitted to the supporting crossbeam 182. A driving motor 185 mounted on the supporting crossbeam 182 is linked to the rotary shaft 183 via a transmission means 186 consisting of a pulley and a belt. A sheet press member 187 is provided at the central part of the supporting crossbeam 182. The sheet press member 187 includes a handle 189 protruding at the upper part of a sheet impingement portion 1888 having a perpendicular wall face for receiving and carrying the sheets 5. At the lower end of the sheet press member 187, a wedge-like sheet separating piece 190 is protruded in the horizontal direction. Fitted vertically slidably to the handle 189 is an air operating rod 191 biased by a spring 192 so that its upper end is constantly protruded. An air opening/closing sensor 193 is secured to the sheet impingement portion 188 at the lower end of the air operating rod 191. The air opening/closing sensor 193 serves to operate an electromagnetic valve for opening and closing a passageway leading to an air ejection hole 194 formed in the sheet separation piece 190. The air ejection surely separates a sheaf of sheets 5 to be carried from another sheaf of sheets 5 thereunder.

Note that numeral 195 designates a stopper device for fixing the sheet press member 187 when being unused in rear of the carrier unit B.

The symbol H represents a driver unit for driving the system as a whole.

The construction of the invention has been described so far. Next, operations of the unpackaging apparatus for the packaged sheets will be explained in detail.

Underslung-Carry of Packaging Sheet

In the packaging sheet loading unit A, the packaging sheet 4 containing the sheets 5 are multistage-loaded on the pallet. The as-loaded pallet is mounted on the lift table 2 by a forklift or the like. The lift table 2 loaded with the packaging sheets 4 is, as depicted in FIG. 8(*a*), raised up to the lower face of the carrier member 7 of the carrier unit B by the chains 3. The bar supporting member 11 and the sucker fitting member 16 are, as illustrated in FIG. 8(*b*), lowered by stretching the lifting air cylinder 15 of the carrier member 7. The suckers 21 fitted to the sucker fitting member 16 are previously set to adsorb the vicinities of four corners of the packaging sheet 4 in accordance with a size of the packaging sheet 4. The adsorption to the packaging sheet involves the following steps. After releasing the fixation of the pivotal shaft 26 with a lock handle 31, the handle 31 is moved along the first guide rails 20*a*. Then, the chain belt 25 integral with the sucker supporting member 22*a* is turned to rotate one gear 27. The other gear 27 meshing with the former is also rotated, thereby moving the other sucker supporting member 22*a* along the first guide rails 20*a* through the chain belt 25. The pinion 28 is also rotated to slide the two racks 29, respectively. The sucker supporting member 22*b* is thus moved along the second guide rails 20*b*. In consequence, the sucker supporting members 22*a* and 22*b* move so that they simultaneously expand outwards or contract inwar It is therefore possible to set the suckers 21 in the vicinities of four corners of the packaging sheet 4. The rotation of the pivotal shaft 26 is refixed by the lock handle 31 to prevent the movements of the sucker supporting members 22*a* and 22*b*. Setting is thus effected. Subsequently, the lifting air cylinder 19 operates to stretch. The sucker fitting member 16 is, as indicated by a broken line of FIG. 8(*b*), further lowered. With this arrangement, the suckers 21 are brought into press-contact with the vicinities of four corners of the packaging sheet 4. The packaging sheet 4 is adsorbed with the air. Thereafter, the lifting air cylinder 19 operates to stretch and contract, thereby raising the sucker fitting member 16. The front and rear sides of the packaging sheet 4 are raised while being bent upwards as illustrated in FIG. 8(*c*). The rodless cylinder 12 of the bar supporting member 11 is operated to simultaneously move the bar frame bodies 13, [illegible] by the broken lined of FIG. 8(*c*), towards the center from both sides. The sheet holder bars [illegible] provided at the lower ends of the frame bodies 13 are inserted under the lower face of the packaging sheet 4 raised while being bent upwards. The glue 6 applied between one packaging sheet 4 and the next packaging sheet 4 overlapped therewith is peeled off. The packaging sheet 4 is, as depicted in FIG. 8(*d*), raised by the sheet holder bars 13*a* with the aid of suckers 21. In this state, the shift air cylinder 10 is stretched to carry the carrier member 7 to the transfer unit C.

Transfer of the Packaging Sheet to the Unpackaging Unit

The packaging sheet 4 grasped by the carrier member 7 is carried onto the transfer board 40 of the transfer unit C. Then operates the rodless cylinder 12 of the bar supporting member 11 of the carrier member 7. The bar frame bodies 13 are simultaneously shifted from the center to the both sides. The sheet holder bars 13*a* provided at the lower ends thereof are released sideways from the packaging sheet 4. At the same moment, the suckers 21 ceases to adsorb, thereby separating the packaging sheet 4 from the carrier member 7. The packaging sheet 4 drops onto the transfer board 40. At this time, the packaging sheet 4, whose front and rear ends are bent upwards, is flattened on the transfer board 40. The sheets 5 are thereby drawn out within the packaging sheet 4, and it follows that the air runs in between the sheets to unbind them. This facilitates separation between the sheets 5. The packaging sheet 4 remains loaded on the transfer board 40. The side guide plates 62 are shifted in close proximity to the packaging sheet 4 by the bottom plate shifting means 66 of the side guide operating mechanism 61. Thereafter, the air cylinder 65 operates to cause the side guide plates 62 to seize the packaging sheet 4 from both sides. The air cylinder 57 of the sheet push operating mechanism 41 stretches to move up the stopper 56. At this time, the stopper piece 52 is moved up by a tensile force of the coil spring 55. The sheet push member 49 connected to the stopper piece 52 projects from the slot 59 formed in the transfer board 40. Subsequently, the driving motor 46 is driven to rotate the driving wheel 47. The sheet push board 43 connected to the belt 48 is caused to slide by rotating the belt 48 wound on the driving wheel 47 and the driven wheels 44, 45. The sheet push member 49 on the sheet push board 43 is thereby shifted forward within the shift hole 60. Hence, the sheet push plate 50 of the sheet push member 49 pushes and feeds out the rear end of the packaging sheet 4 up to the unpackaging unit D.

Unpackaging of the Packaging Sheet

When the packaging sheet 4 is fed out to the unpackaging unit D, the two side faces of the packaging sheet 4 impinge on the two guide plates 74 of the side cutter mechanism 70 and guided therebetween. At the same time, the upper face of the packaging sheet 4 is pressed by the presser plate 75, thus preventing its upward movement. In this state, the packaging sheet 4 is certainly fed in between the two side cutters 73, 73. The side cutters 73, 73 rotationally driven by the driving motor 72 cut open the side faces thereof as the packaging sheet 4 is fed forward. The top end of the packaging sheet 4 is transferred above the slot 101 bored in the receiving board 95 of the lower unpackaging mechanism 65. At this time, the photo sensor device 102 operates. Consequently, the packaging sheet 4 is stopped surely in the top end position of the receiving board 95. The front cutter mechanism 76 is placed in the top end position of the receiving board 95. The front cutter 80 mounted thereon operates, and the safety guide members 83 of the cut-open edge pieces 81 of the front cutter 80 are inserted on one top end side, e.g., the front side of the packaging sheet 4. Simultaneously, the cutting edges 82 set in the recesses thereof approach the front sheet portion of the packaging sheet 4. The front cutter 80 moves crosswise from the front side to the rear side along the front sheet portion by operating the rodless cylinder 79. The cutting edges push-cut the front sheet portion without causing any rotation, thus unpackaging this portion. The cutting edges 82 do not directly contact the sheets 5 within the packaging sheet 4 owing to the safety guide member 83. Damages to the sheets 5 are thus prevented. Then operate the upper and lower unpackaging mechanisms 85 and 93. In the upper unpackaging mechanism 85, the suckers 92 attached to the top end of the rotary arm 90 adsorb the upper half of the unpackaged packaging sheet 4. The rotary arm 90 is rotated upwards by the air cylinder 91, and hence the upper half of the packaging sheet 4 is turned upwards. On the other hand, in the lower unpackaging mechanism 93, the suckers 94 attached to the receiving board 95 simultaneously adsorb the lower half of the unpackaged packaging sheet 4. The receiving board 95 is rotated from the horizontal position towards the lower rear side by means of the air cylinder 96, whereby the lower half of the packaging sheet 4 is turned downwards. At this time, a sheaf of the sheets 5 contained in the packaging sheet 4 tend to dangle together with the lower half of the packaging sheet 4. Particular in the case of thin sheets, this phenomenon becomes conspicuous. The sheet receiving plate 97 is turned to the top end position of the transfer board 40 in place of the receiving board 95 by operating a link mechanism of the connecting rods 99 and 100, using the air cylinder 98. Therefore, the sheets 5 which are going to dangle are received. In combination with a turn-up of the upper half of the packaging sheet 4 by operating the upper unpackaging mechanism 85, the front part of the sheets 5 contained in the packaging sheet 4 are exposed in good order on the transfer board 40. The sheet removing mechanism 103 then functions. To start with, the pinion 107 of the bearing plate 105 rotationally engages with the rack 104 by rotary driving of the driving motor 108. The bearing plate 105 is thereby moved towards the top end of the transfer board 40 disposed behind. The upper and lower seizing pieces 114 and 115 of the seizing member 113 vertically provided on the bearing plate 105 are inserted upwardly downwardly of the front ends of the sheets 5 exposed on the transfer board 40. At this time, the air is ejected from the air ejection hole 116 formed in the top end of the lower seizing piece 115, thereby separating the front ends of the sheets 5 from the sheet receiving plate 97. The lower seizing piece 115 is surely inserted under the lower face of a sheaf of the sheets 5. The upper seizing piece 114 is lowered by the air cylinder 117. The sheets 5 are forcibly press-seized by the upper and lower seizing pieces 114 and 115. Subsequently, the driving motor 108 is rotationally driven in the direction reverse to the previous one to move the bearing plate 105 forwards. As a result, the sheets 5 press-seized by the upper and lower seizing pieces 114 and 115 are pulled out of the unpackaged packaging sheet 4. The sheets 5 are loaded on the bottom plate 169 mounted on the carrier pallet on the lift table incorporated in the sheet housing unit F.

Discharge of the Empty Packaging Sheet

When the packaging sheet becomes empty after the sheets 5 have been pulled out, the packaging sheet lifting/shifting mechanism 126 of the discharge unit E operates. Positions of the suckers 147 fitted to the sucker fitting member 139 are at first set. This setting operation involves the step of adjusting the stretch and contraction of the shift plate **139*b* through the auxiliary plate 135*a* by driving the rodless cylinder 146. Next, the pat fitting plate member 135 is descended by operating the air cylinder 132. The pats 136 fitted thereto are made to elastically contact the empty packaging sheet 4 with an elasticity of the spring 137 to press it on the transfer board 40. In this state, the frame body 139*a* and the shift plate 139*b* of the sucker fitting member 139 are lowered by actuating the air cylinder 141. The suckers 144 fitted thereto adsorb the empty packaging sheet 4. Thereafter, the pat fitting plate member 135 and the sucker fitting member 139 are raised by operating the air cylinder 132. The empty packaging sheet 4 adsorbed by the suckers 147 is lifted from the transfer board 40. In this state, the packaging sheet lifting/shifting mechanism 126 is retreated to a position of the discharge hole 120 formed behind by actuating the air cylinder 129. The shift frame body 130 is shifted from the center of the transfer board 40 towards the discharge hole 120 by actuating the air cylinder 131. The empty packaging sheet 4 adsorbed by the suckers 147 fitted to the sucker fitting member 139 of the shift frame body 130 is fed in between the driving roller 122 disposed in front of the discharge hole 120 and the driven roller 123 thereabove. The driven roller 123 is rotated downwards by actuating the air cylinder 125. The empty packaging sheet 4 is put in between the driven roller 123 and the driving roller 122 and is then pressed. At the same moment, the empty packaging sheet 4 is sandwiched in between the driving motor 121 and the driven roller 122 rotationally driven by this motor 121 and fed out. The empty packaging sheet 4 is then discharged from the discharge hole 120**.

Rearrangement Loading of the Sheets

The sheets 5 drawn out of the packaging sheet 4 unpackaged by the unpackaging unit D are loaded on the bottom plate 169 disposed on the carrier pallet on the lift table incorporated in the sheet loading unit F. At this time, the air is intensively ejected from the air ejection hole 171 formed in the front top end of the transfer board 40 and blown in between the sheets 5. This promotes the separation between the sheets 5. The sheet presser piece 156 of the sheet presser mechanism 150 is retreated from a position indicated by the solid line of FIG. 22 by the air cylinder 155 and retracted into the side wall face 1h. The sheet press piece 156 smoothly pulls out the sheets 5 seized by the upper and lower seizing pieces 114 and 115 of the sheet removing mechanism 103. The sheet press piece 156 then leads the sheets 5 to the sheet loading unit F. The sheets are loaded on the bottom plate 169. When the sheets 5 have been loaded on the bottom plate 169, the sheet presser piece 156 is, as shown by an arrow of FIG. 22, ascended from the retreat position, moved forward and lowered by operating the air cylinders 153 and 155. Thus, the sheet presser piece 156 press-holds the sheets 5 loaded on the bottom plate 169. The sheets 5 are, however, disorderly loaded on the bottom plate 169 after being pulled out of the unpackaging unit D. The sheet rearranging mechanisms 157 provided on the three wall portions of the sheet loading unit F function as follows. When the sheets 5 drawn out are loaded on the bottom plate 169, the supporting member 161 advances with rotations of the screw rod 159. The impingement plate 167 provided at the lower end thereof is moved close to the bottom plate 169. Subsequently, the adjusting plate 162 is moved forwards by operating the air cylinder 164. Fitted to the protrusions 170 of the bottom plate 169 are the notches 168 of the impingement plate 167 connected via the buffer elastic material 165 to the adjusting plate 162. The impingement plate 167 is thus impinged on the irregular sheets 5. The vibrator 166 operates to cause fine vibrations of the impingement plate 167. Only the impingement plate 167 minutely vibrates at a high efficient owing to the buffer elastic material 165. The sheets 5 disorderly loaded on the bottom plate 169 are rearranged in good order. This eliminates a troublesome process to manually rearrange the ununiform sheets 5 initially loaded on the bottom plate 169. Thus, the sheets 5 can simply surely be rearranged. Sheaves of the sheets 5, which have been fed onto the rearranged sheets 5 next and thereafter, are also rearranged in the following manner. The impingement plate 167 is moved forwards to impinge on the ununiform sheets 5 which can, in turn, be easily rearranged for loading by similarly causing fine vibrations of the impingement plate 167 with the vibrator 166.

Feed-Out of the Bulk Sheets

When feeding out the sheets 5 loaded in bulk on the packaging sheet loading unit A, the stopper device 195 of the bulk sheet feed mechanism G is released. A desired amount of the sheet 5 to be fed out from the upper bulk sheets 5 are slightly raised by hands. The sheet separation piece 190 provided at the lower end of the sheet press member 187 is inserted therebetween. The air operating rod 191 projecting from the upper handle 189 is pushed. The air opening/closing sensor 193, when sensing this, opens the electromagnetic valve to eject the air from the air ejection hole 194 bored in the sheet separation piece 190. The desired amount of the sheets 5 to be fed out are certainly separated from the sheets 5 thereunder. The desired amount of sheets 5 impinge upon a sheet impingement portion 188 provided at the inner end of the sheet separation piece 190. When rotating the rotary shift 183 via the transmission means 186 by driving the driving motor 185. The pinion 184 attached to the rotary shaft 183 engages with the rack 180 and rotates to move the support crossbeam 182 towards the transfer unit C. The desired amount of the sheets 5 impinging on the sheet impingement portion 188 are smoothly fed out to the transfer unit C. The fed sheets 5 are rearranged while being held from both sides by the side guide plates 62 of the transfer unit C. The sheets 5 are sent while being pressed by the sheet push member 49. Unlike the packaging sheet 4, the sheets 5 are seized by the upper and lower seizing pieces 114 and 115 of the sheet removing mechanism 103 without undergoing the unpackaging process. The sheets 5 are then transferred to the sheet loading unit F. At this time, the air is blown in between the sheets 5 from the air ejection hole 171. The sheets 5 are well separated and loaded on the sheet loading unit F.

It is to be noted that in the embodiment discussed above, the constructions in the respective sections are attainable by incorporating them as parts into this kind of conventional apparatuses.

Although the illustrative embodiment has been described in detail with reference to the accompanying drawings, it is to be understood that the present invention is not limited to this embodiment. Various changes or modifications may be effected therein by one skilled in the art without departing from a scope or spirit of the invention.

What is claimed is:

1. An unpackaging apparatus for packaged sheets, comprising:

a packaging sheet loading unit capable of being loaded with packaging sheets or bulk sheets;

a housing unit for housing said processed sheets; and a means, provided between said packaging sheet loading unit and said housing unit, for processing said packaging sheets or said bulk sheets, said processing means including:

a carrier means for carrying said packaging sheet in said loading unit to a transfer unit by adsorptively holding said packaging sheets;

a guide means, provided in said transfer unit, for guiding said carried packaging sheet to a predetermined position of an unpackaging unit;

a means, provided in said unpackaging unit, for cutting front and side faces of said packaging sheet;

a means for vertically expanding said cut packaging sheet;

a rearranging means for rearranging said sheets removed from said expanded packaging sheet and loading said sheets in said housing unit;

a discharge means for discharging an empty packaging sheet from which said sheets have been removed from a part vicinal to said unpackaging unit; and a feed means for feeding out said bulk sheets in said loading unit to said transfer unit.

2. The apparatus as set forth in claim 1, wherein said carrier means is characterized in that: a transfer passageway leading to said unpackaging unit is provided upwardly of said packaging sheet loading unit; a carrier member is movably mounted on said passageway; a bar supporting member is mounted in a liftable manner on an upper frame body provided on said carrier member; said bar supporting member is fitted with sheet holder bars movable from front and rear sides of said carrier member towards a center of said packaging sheet; a sucker fitting member is provided at its lower end with suckers for adsorptively underslung-holding said uppermost packaging sheet in said packaging sheet loading unit; said sucker fitting member is so mounted to be ascendable and descendable; and said packaging sheet raised by said suckers is carried while being underslung-held with said sheet holder bars.

3. The apparatus as set forth in claim 1, wherein said guide means is characterized in that: a carry-in passageway for said carrier member holding said packaging sheet is formed above a transfer board; a slot is bored in said transfer board on the carry-in side; a shift hole communicating with said slot is bored towards said unpackaging unit; a sheet push member is so fitted as to be retractable into said slot; a sheet push operating mechanism is provided to make said sheet push member shiftable along said shift hole while said sheet push member remains protruded; side guide plates disposed on both sides of said transfer board move expansively or narrowly from both sides in accordance with a size of said packaging sheet; and a side guide operating mechanism for adjusting said side guides exactly to a predetermined position of said unpackaging unit is provided.

4. The apparatus as set forth in claim 1, wherein said means for cutting said front face of said packaging sheet is characterized in that: a supporting arm fitted with a front cutter to traverse a transfer board is slidably provided in said unpackaging unit disposed on a top end side of said transfer board; said front cutter includes protruded cut-open edges having substantially U-shaped recesses; cutting edges are formed inwardly of said recesses; safety guides are shaped on outer peripheries thereof; and said front face of said packaging sheet is push-cut transversely without causing any rotation of said front cutter.

5. The apparatus as set forth in claim 1, wherein said means for expanding said packaging sheet is characterized in that: a receiving board has suckers for adsorbing said cut packaging sheet; said receiving board is rotatably pivotally fitted to make an obtuse angle greater than 90° on a lower rear side from a horizontal position of the top end of said transfer board in said unpackaging unit disposed on the top end side of said transfer board; a sheet receiving plate confronting said receiving board is provided in a lower position than a rotary trajectory of said receiving board; said sheet receiving plate is turned to the top end position of said transfer board in place of said receiving plate; and said sheets are removed from within said packaging sheet.

6. The apparatus as set forth in claim 1, wherein said means for rearranging said sheets is characterized in that: a bottom plate loaded with said sheets and having a rugged periphery is provided in said sheet housing unit for housing said sheaves of sheets removed from said expanded packaging sheet or said sheaves of bulk sheets; a sheet rearranging mechanism corresponding to said bottom plate is disposed on said outer periphery of said bottom plate; said sheet rearranging mechanism is fitted with an impingement plate having notches engaging with said rugged portion of said bottom plate, said impingement plate being so provided as to be approachable or movable away from said bottom sheet; and a vibrator mounted therein gives fine vibrations to said sheets on said bottom plate, thus rearranging said sheet.

7. The apparatus as set forth in claim 1, wherein said means for discharging said packaging sheet is characterized in that: a discharge unit is provided on one rear side in a vicinity of said unpackaging unit; a packaging sheet lifting/shifting mechanism is movably installed between said unpackaging unit and said discharge unit; said packaging sheet lifting/shifting mechanism includes suckers for adsorbing said empty packaging sheet and a shift frame body for shifting said packaging sheet to said discharge unit; and said empty packaging sheet unpackaged by said unpackaging unit is discharged to said discharge unit by said packaging sheet lifting/shifting mechanism.

8. The apparatus as set forth in claim 1, wherein said feed means for feeding said bulk sheets is characterized in that: a sheet press member for transferring said sheets to a transfer board is disposed upwardly of said packaging sheet loading unit; a sheet impingement portion is vertically provided on said sheet press member; a wedge-like sheet separation piece is horizontally protruded from a lower end of said sheet impingement portion; said sheet press member is provided with an air operating mechanism including an air ejection hole bored in the top end of said sheet separation piece; said sheets of a feed quantity are separated by blowing the air in between said bulk sheets and fed out by said sheet press member.

* * * * *